US007448706B2

(12) United States Patent
Yamanobe

(10) Patent No.: US 7,448,706 B2
(45) Date of Patent: Nov. 11, 2008

(54) IMAGE FORMING APPARATUS AND METHOD

(75) Inventor: Jun Yamanobe, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 283 days.

(21) Appl. No.: 11/236,543

(22) Filed: Sep. 28, 2005

(65) Prior Publication Data

US 2006/0066646 A1 Mar. 30, 2006

(30) Foreign Application Priority Data

Sep. 29, 2004 (JP) ..... 2004-285104

(51) Int. Cl.
*B41J 29/38* (2006.01)

(52) U.S. Cl. ..... 347/5; 347/9; 347/14

(58) Field of Classification Search ..... 347/19, 347/5, 9, 10–12, 14, 15; 445/24
See application file for complete search history.

(56) References Cited

U.S. PATENT DOCUMENTS 6,645,029 B2 * 11/2003 Akahira ..... 445/24
6,648,438 B1 11/2003 Tandou et al.

FOREIGN PATENT DOCUMENTS

JP 11-277733 A 10/1999
JP 2000-62148 A 2/2000

* cited by examiner

*Primary Examiner*—Lam S Nguyen
(74) *Attorney, Agent, or Firm*—Birch, Stewart, Kolasch & Birch, LLP

(57) ABSTRACT

The image forming apparatus comprises: a recording head which includes a plurality of nozzles through which droplets of liquid are ejected to and deposited on a recording medium to form dots on the recording medium, the nozzles being arranged in a nozzle row; a conveyance device which causes the recording head and the recording medium to move relatively to each other by conveying at least one of the recording head and the recording medium in a relative movement direction; a storage device which, of information indicating an amount of deposition position displacement from an ideal deposition position of the dots formed by the droplets ejected from the nozzles, stores information about the amount of deposition position displacement in at least a direction perpendicular to the relative movement direction of the conveyance device; a line figure recognition processing device which carries out processing for recognizing line figures from image data for printing; an ideal line identification device which determines an ideal line obtained by linking centers of the respective dots formed when printing a line figure, assuming that there is absolutely no deposition position displacement produced by any of the nozzles, in respect of the line figure recognized by the line figure recognition processing device; and an ejection timing control device which, when printing a line figure, controls ejection timing of a defective nozzle which produces deposition position displacement in a direction perpendicular to the relative movement direction, according to the information about the amount of deposition position displacement stored in the storage device and the ideal line determined by the ideal line identification device, in such a manner that a deposition center position of a dot formed by a droplet ejected from the defective nozzle moves closer to the ideal line, along the relative movement direction.

9 Claims, 15 Drawing Sheets

IDEAL OBLIQUE LINE

WHEN EJECTION DIRECTION OF CENTER NOZZLE IS DISPLACED TOWARD RIGHT

WHEN EJECTION DIRECTION OF CENTER NOZZLE IS DISPLACED TOWARD RIGHT

IDEAL OBLIQUE LINE

IMAGE FORMING APPARATUS AND METHOD

BACKGROUND OF THE INVENTION

1. Field of the Invention

The present invention relates to an image forming apparatus and method, and more particularly, to droplet ejection control technology suitable for reducing deterioration in image quality caused by ejection errors in nozzles of a recording head (which may also be referred to as a "print head") having nozzle rows in which a plurality of liquid ejection ports (nozzles) are arranged.

2. Description of the Related Art

In an inkjet recording apparatus (printer), there is a problem in that the position of dots deposited on a recording medium may be displaced from their ideal positions (hereafter, this is referred to as "deposition position displacement"), due to causes such as variation in the ink ejection direction from the nozzles, displacement of the nozzle positions, displacement of the positions of the respective color heads, and so on., and consequently, print quality is impaired. In particular, when printing lines in graphs, figures or the like, or text, the decline in quality caused by displacement of the dot positions from ideal positions is particularly severe, and becomes a very important problem in terms of the quality of the printer (hereinafter, the quality of lines in graphs or figures, and text, is referred to as "line quality").

The phenomenon of decline in line quality is now described with reference to FIGS. 17A and 17B, which show schematic drawings of situations in which an oblique row of dots (oblique line) is printed on a recording medium by ejecting ink from the nozzles in a line head. In FIGS. 17A and 17B, reference numeral 200 indicates a line head, reference numeral 202-*i* (i=1, 2, 3, 4, 5) indicates a nozzle, reference numeral 204-*i* indicates a dot deposited by a nozzle 202-*i* (i=1, 2, 3, 4, 5), and reference numeral 206-*i* indicates the center position of the dot. Furthermore, arrow A indicates the relative conveyance direction of the recording medium (for example, the recording paper) with respect to the line head 200.

FIG. 17A is a diagram in which an ideal oblique line is printed by ejecting ink normally from all of the five nozzles. Furthermore, FIG. 17B shows a row of dots formed in a case where the central nozzle 202-3 has produced an ejection error and the ejection direction is displaced toward the right.

As shown in FIG. 17B, when an oblique line is printed in a case where the ejection direction of the central nozzle 202-3 shifted to the right, if droplets are ejected under the same ejection control (ejection timings) as FIG. 17A, the dot 204-3 formed by the defective nozzle 202-3 is deposited in a position shifted to the right (FIG. 17B). Following the dot row (oblique line) in the line direction, a projection or depression is caused by the displaced dot 204-3. These projection and depression in the row of dots cause deterioration in line quality.

As described above, the depressions and projections in the dot row occurring as a result of deposition position displacement of the dots is a major cause of deterioration in line quality. Furthermore, in the inkjet recording apparatuses, decline in line quality is especially notable in the case of oblique lines such as that shown in FIGS. 17A and 17B.

In response to problems of deteriorated print quality due to deposition position displacement, technology has been proposed for preventing deposition position displacement by controlling the ejection timing from the respective nozzles (see Japanese Patent Application Publication Nos. 11-277733 and 2000-62148, for example).

Japanese Patent Application Publication No. 11-277733 discloses correction of positional displacement within the space of one dot, by dividing the ink ejection time for one dot into a plurality of time periods, and controlling the ink ejection timing between these divided times. On the other hand, Japanese Patent Application Publication No. 2000-62148 describes providing a device for delaying the ink ejection time in order to cancel out deposition position displacement in a line head.

Many of the technologies proposed conventionally in order to prevent deposition position displacement correct deposition position displacement in the main scanning direction (the shuttle movement direction) in the case of a shuttle scanning head, and in the sub-scanning direction (paper conveyance direction) in the case of a line head. In the case of deposition position displacement in these directions, the dot deposition positions are amended by controlling the ejection timing, and dot positions without any deposition position displacement (hereinafter referred to as "ideal positions") are achieved.

However, in the case of deposition position displacement in a direction (hereinafter referred to as the "nozzle row direction") which is perpendicular to the aforementioned direction, it is not possible to cause a dot to be deposited at the ideal position, even if the ejection timing is altered. With regard to this point, Japanese Patent Application Publication No. 2000-62148 points out the issue of deposition position displacement in the nozzle row direction, and states that "the ink ejection timings of the respective nozzles are delayed in such a manner that positional displacement is cancelled out"; however, Japanese Patent Application Publication No. 2000-62148 provides no concrete disclosure with regard to the method of resolving deposition position displacement.

SUMMARY OF THE INVENTION

The present invention has been contrived in view of the foregoing circumstances, an object thereof being to provide an image forming method and apparatus which can restrict deterioration in line quality resulting from positional displacement of dots in a direction perpendicular to the relative movement direction of a recording head and recording medium (which corresponds to the nozzle row direction described above) due to an ejection direction abnormality in a nozzle.

In order to attain the aforementioned object, the present invention is directed to an image forming apparatus, comprising: a recording head which includes a plurality of nozzles through which droplets of liquid are ejected to and deposited on a recording medium to form dots on the recording medium, the nozzles being arranged in a nozzle row; a conveyance device which causes the recording head and the recording medium to move relatively to each other by conveying at least one of the recording head and the recording medium in a relative movement direction; a storage device which, of information indicating an amount of deposition position displacement from an ideal deposition position of the dots formed by the droplets ejected from the nozzles, stores information about the amount of deposition position displacement in at least a direction perpendicular to the relative movement direction of the conveyance device; a line figure recognition processing device which carries out processing for recognizing line figures from image data for printing; an ideal line identification device which determines an ideal line obtained by linking centers of the respective dots formed when printing a line figure, assuming that there is absolutely no deposition position displacement produced by any of the nozzles, in respect of the line figure recognized by the line figure recognition processing device; and an ejection timing control device which, when printing a line figure, controls ejection timing of a defective nozzle which produces deposition position displacement in a direction perpendicular to the relative movement direction, according to the information about the amount of deposition position displacement stored in the storage device and the ideal line determined by the ideal line identification device, in such a manner that a deposition center position of a dot formed by a droplet ejected from the defective nozzle moves closer to the ideal line, along the relative movement direction.

According to the present invention, the deposition position displacement from an ideal deposition position is previously ascertained with respect to the dots formed by droplets ejected from the respective nozzles of the recording head and this information is stored in the storage device. The deposition position displacement may be represented as a direction of displacement and an amount of displacement, with respect to an ideal deposition position (for example, it may be expressed as a vector based on a two-dimensional coordinates system). The information is stored about the amount of deposition position displacement for at least the component in the direction perpendicular to the relative movement direction of the recording head and the recording medium, but more desirably, information about the amount of deposition position displacement in the relative movement direction is also stored.

When data for an image to be printed is supplied, prescribed data processing is carried out, and the contents of the image data for printing are analyzed. In other words, the line figure portions are recognized from amongst the image data, by the line figure recognition processing device, and an ideal line is determined by the ideal line identification device, in respect of the identified line figure. A "line figure" includes line segments and curves, such as graphs, drawings, or text, as well as boundaries (border lines) between regions of different colors.

From the ideal line thus obtained and the information about the amount of deposition position displacement stored previously in the storage device, the ejection timing of a defective nozzle is corrected (controlled) by taking account of the relative movement speed of the recording head and the recording medium, so that the deposition position in the relative movement direction is corrected in such a manner that the deposition center position of the dot formed by a droplet ejected from the defective nozzle overlaps with the ideal line, or comes to a position closer to the ideal line. By this means, projections and depressions in the row of dots which depict the line figure are reduced, and therefore, decline in line quality can be restricted. The present invention provides technology which is especially valuable when printing an oblique line which is not parallel with the relative movement direction.

Preferably, when printing the line figure, taking the direction perpendicular to the relative movement direction to be an X axis, the relative movement direction to be a Y axis, an ideal deposition center position supposing that there is absolutely no deposition position displacement produced by the defective nozzle to be (X0, Y0), the deposition center position in a case where no correction of the ejection timing is carried out with respect to the defective nozzle to be (X1, Y1), the deposition center position after correction to be (X2, Y2), a function representing the ideal line to be $Y=f(X)$, and a relative movement speed produced by the conveyance device to be V, then the ejection timing control device determines an amount of correction $\Delta t$ of the ejection timing by the following equation: $\Delta t=(Y2-Y1)/V=(f(X1)-Y1)/V$.

According to the present invention, by introducing the two-dimensional coordinates system in which the relative movement direction is the Y axis and the direction perpendicular to this is the X axis, at the surface of the recording medium, and by calculating the amount of correction (correction time) for the ejection timing on this basis, it is possible to simplify the calculation performed by the control system.

Preferably, when printing the line figure, if the ideal line is a straight line, then, taking the amount of deposition position displacement in the direction perpendicular to the relative movement direction to be $\Delta d$, and the amount of deposition position displacement in the relative movement direction to be $\Delta d'$, of the amount of deposition position displacement between an ideal deposition center position supposing that there is absolutely no deposition position displacement produced by the defective nozzle and the deposition center position when no correction of the ejection timing is carried out in respect of the defective nozzle, taking an angle formed between the ideal line and a straight line aligned in the direction perpendicular to the relative movement direction to be $\theta$, and a relative conveyance speed produced by the conveyance device to be V, then the ejection timing control device determines an amount of correction $\Delta t$ of the ejection timing by the following equation: $\Delta t=(\Delta d\times\tan\theta-\Delta d')$.

According to the present invention, by calculating the amount of correction (correction time) for the ejection timing used when the ideal line is a straight line, it is possible to simplify the calculation performed by the control system.

Preferably, the ejection timing control device implements control of the ejection timing only in respect of a nozzle at which the amount of deposition position displacement in the direction perpendicular to the relative movement direction exceeds a prescribed reference value.

Desirably, the "prescribed reference value" is the minimum value at which decline in the line quality (and in particular, projections and depressions in the line caused by deposition position displacement) are visible. By omitting to carry out correction in respect of very slight deposition position displacement of a level which is not visible, it is possible to reduce the burden on the system (control system, calculation system), without giving rise to practical problems.

Preferably, in a case where deposition position displacements are produced respectively in the dots formed by droplets ejected from two of the nozzles capable of forming two dots that are mutually adjacent in the direction perpendicular to the relative movement direction, if these deposition position displacements are produced in mutually divergent directions with respect to the direction perpendicular to the relative movement direction, then the ejection timing control device implements control of the ejection timing only in respect of one of the two nozzles that produces a larger amount of deposition position displacement in the direction perpendicular to the relative movement direction than the other of the two nozzles.

In cases where deposition position displacement is produced respectively by two nozzles capable of forming two dots that are mutually adjacent in the direction perpendicular to the relative movement direction of the recording head and the recording medium, and where these respective deposition position displacements are produced in mutually divergent directions with respect to the direction perpendicular to the paper conveyance direction, then if the ejection timing of both nozzles is corrected in order to correct the deposition positions produced by the two nozzles, it may happen that the distance between the centers of the dots ejected from the two nozzles becomes greater than the distance prior to correction (the distance between the dots increases), thus making the line become narrower in that section (or causing the line to be broken). Therefore, in order to avoid situations of this kind, there is a mode in which correction is implemented only in respect of the nozzle producing the larger deposition position displacement, of the two nozzles.

Preferably, in a case where deposition position displacements are produced respectively in the dots formed by droplets ejected from two of the nozzles capable of forming two dots that are mutually adjacent in the direction perpendicular to the relative movement direction, if these deposition position displacements are produced in mutually divergent directions with respect to the direction perpendicular to the relative movement direction, then the ejection timing control device implements control of the ejection timing in respect of the two nozzles in such a manner that the deposition center positions of the respective dots formed by the droplets ejected from the two nozzles lie between the ideal line and the deposition center positions produced when no ejection timing control is performed.

According to the present invention, the ejection timing is corrected in respect of both of the two nozzles, but the deposition center positions of the dots formed by droplets ejected from the nozzles are not made to overlap with the ideal line, but rather, are brought to intermediate positions closer to the ideal line. Therefore, it is possible to prevent narrowing (or breaking) of the line as described above.

A compositional example of the recording head according to the present invention is a full line type head having a nozzle row in which a plurality of nozzles are arranged through a length corresponding to the full width of the recording medium. In this case, a mode may be adopted in which a plurality of relatively short ejection head blocks having nozzles rows which do not reach a length corresponding to the full width of the recording medium are combined and joined together, thereby forming nozzle rows of a length that correspond to the full width of the recording medium.

A full line type ejection head is usually disposed in a direction that is perpendicular to the relative feed direction (relative conveyance direction) of the recording medium, but a mode may also be adopted in which the ejection head is disposed following an oblique direction that forms a prescribed angle with respect to the direction perpendicular to the conveyance direction.

When forming color images, it is possible to provide full line type recording heads for each color of a plurality of colored inks (recording liquids), or it is possible to eject recording inks of a plurality of colors, from one recording head.

The term "recording medium" indicates a medium on which an image is recorded by means of the action of the recording head (this medium may also be called a print medium, image forming medium, image receiving medium, or the like). This term includes various types of media, irrespective of material and size, such as continuous paper, cut paper, sealed paper, resin sheets, such as OHP sheets, film, cloth, an intermediate transfer medium, a printed circuit board on which a wiring pattern, or the like, is formed by means of a recording head and the like.

The conveyance device for causing the recording medium and the recording head to move relative to each other may include a mode where the recording medium is conveyed with respect to a stationary (fixed) recording head, or a mode where a recording head is moved with respect to a stationary recording medium, or a mode where both the recording head and the recording medium are moved.

Furthermore, the present invention may is not limited to a full line head, and may also be applied to a shuttle scanning type recording head (a recording head which ejects droplets while moving reciprocally in a direction substantially perpendicular to the conveyance direction of the recording medium).

In order to attain the aforementioned object, the present invention is also directed to an image forming method of forming an image on a recording medium by ejecting droplets of liquid from a plurality of nozzles arranged in a nozzle row in a recording head, to the recording medium to form dots on the recording medium, while causing the recording head and the recording medium to move relatively to each other by conveying at least one of the recording head and the recording medium in a relative movement direction, comprising the steps of: storing, of information indicating an amount of deposition position displacement from an ideal deposition position of the dots formed by the droplets ejected from the nozzles, information about the amount of deposition position displacement in at least a direction perpendicular to the relative movement direction; carrying out processing for recognizing line figures from image data for printing; determining an ideal line obtained by linking centers of the respective dots formed when printing a line figure, assuming that there is absolutely no deposition position displacement; controlling, when printing a line figure, ejection timing of a defective nozzle which produces deposition position displacement in a direction perpendicular to the relative movement direction, according to the information about the amount of deposition position displacement stored in the storing step and the ideal line determined in the determining step, in such a manner that a deposition center position of a dot formed by a droplet ejected from the defective nozzle moves closer to the ideal line, along the relative movement direction.

According to the present invention, information relating to the amount of deposition position displacement in the direction perpendicular to the relative movement direction of the recording head and the recording medium is previously stored for each of the nozzles, and furthermore, line figures are recognized by analyzing the print image data, an ideal line is determined for the line figures, and the ejection timing from the defective nozzle is controlled in such a manner that the deposition position in the relative movement direction is corrected so that the deposition center position of a dot formed by a droplet ejected from the defective nozzle moves to a position closer to the ideal line. Therefore, the depressions and projections of the row of dots depicting the line figures are reduced, and decline in line quality can be restricted.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

General Configuration of Inkjet Recording Apparatus

Figure 1:
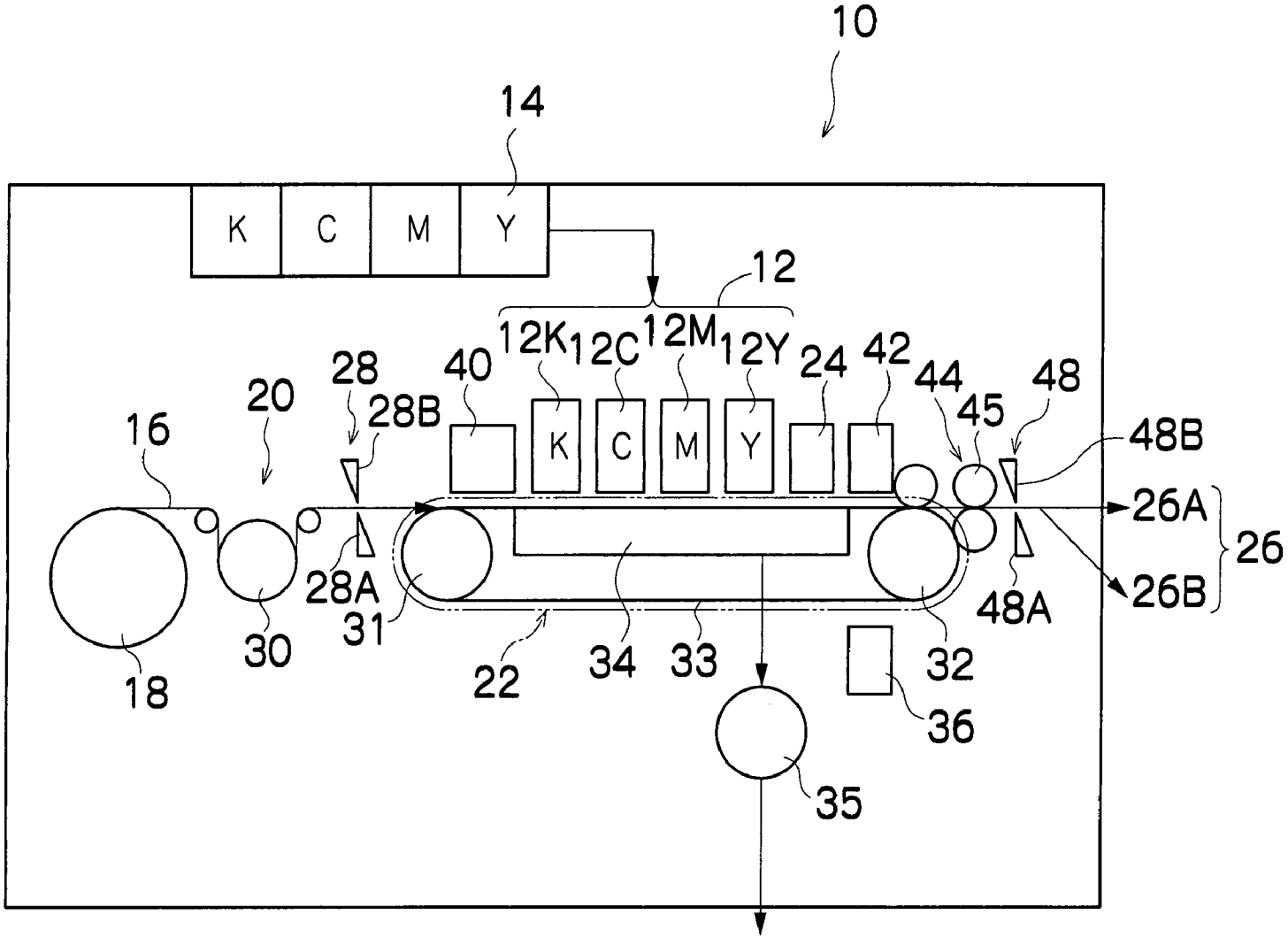
FIG. 1 is a general schematic drawing of an inkjet recording apparatus which forms one embodiment of an image forming apparatus according to the present invention.

FIG. 1 is a general configuration diagram of an inkjet recording apparatus showing one embodiment of an image forming apparatus according to the present invention. As shown in FIG. 1, the inkjet recording apparatus 10 comprises: a printing unit 12 having a plurality of inkjet recording heads (hereinafter referred to as "heads") 12K, 12C, 12M, and 12Y provided for ink colors of black (K), cyan (C), magenta (M), and yellow (Y), respectively; an ink storing and loading unit 14 for storing inks of K, C, M and Y to be supplied to the print heads 12K, 12C, 12M, and 12Y; a paper supply unit 18 for supplying recording paper 16 which is a recording medium; a decurling unit 20 removing curl in the recording paper 16; a suction belt conveyance unit 22 disposed facing the nozzle face (ink-droplet ejection face) of the printing unit 12, for conveying the recording paper 16 while keeping the recording paper 16 flat; a print determination unit 24 for reading the printed result produced by the printing unit 12; and a paper output unit 26 for outputting image-printed recording paper (printed matter) to the exterior.

The ink storing and loading unit 14 has ink tanks for storing the inks of K, C, M and Y to be supplied to the heads 12K, 12C, 12M, and 12Y, and the tanks are connected to the heads 12K, 12C, 12M, and 12Y by means of prescribed channels. The ink storing and loading unit 14 has a warning device (for example, a display device or an alarm sound generator) for warning when the remaining amount of any ink is low, and has a mechanism for preventing loading errors among the colors.

In FIG. 1, a magazine for rolled paper (continuous paper) is shown as an example of the paper supply unit 18; however, more magazines with paper differences such as paper width and quality may be jointly provided. Moreover, papers may be supplied with cassettes that contain cut papers loaded in layers and that are used jointly or in lieu of the magazine for rolled paper.

In the case of a configuration in which a plurality of types of recording paper can be used, it is preferable that an information recording medium such as a bar code and a wireless tag containing information about the type of paper is attached to the magazine, and by reading the information contained in the information recording medium with a predetermined reading device, the type of recording medium to be used (type of medium) is automatically determined, and ink-droplet ejection is controlled so that the ink-droplets are ejected in an appropriate manner in accordance with the type of medium.

The recording paper 16 delivered from the paper supply unit 18 retains curl due to having been loaded in the magazine. In order to remove the curl, heat is applied to the recording paper 16 in the decurling unit 20 by a heating drum 30 in the direction opposite from the curl direction in the magazine. The heating temperature at this time is preferably controlled so that the recording paper 16 has a curl in which the surface on which the print is to be made is slightly round outward.

In the case of the configuration in which roll paper is used, a cutter (first cutter) 28 is provided as shown in FIG. 1, and the continuous paper is cut into a desired size by the cutter 28. The cutter 28 has a stationary blade 28A, of which length is not less than the width of the conveyor pathway of the recording paper 16, and a round blade 28B, which moves along the stationary blade 28A. The stationary blade 28A is disposed on the reverse side of the printed surface of the recording paper 16, and the round blade 28B is disposed on the printed surface side across the conveyor pathway. When cut papers are used, the cutter 28 is not required.

The decurled and cut recording paper 16 is delivered to the suction belt conveyance unit 22. The suction belt conveyance unit 22 has a configuration in which an endless belt 33 is set around rollers 31 and 32 so that the portion of the endless belt 33 facing at least the nozzle face of the printing unit 12 and the sensor face of the print determination unit 24 forms a horizontal plane (flat plane).

The belt 33 has a width that is greater than the width of the recording paper 16, and a plurality of suction apertures (not shown) are formed on the belt surface. A suction chamber 34 is disposed in a position facing the sensor surface of the print determination unit 24 and the nozzle surface of the printing unit 12 on the interior side of the belt 33, which is set around the rollers 31 and 32, as shown in FIG. 1. The suction chamber 34 provides suction with a fan 35 to generate a negative pressure, and the recording paper 16 is held on the belt 33 by suction.

The belt 33 is driven in the clockwise direction in FIG. 1 by the motive force of a motor 88 (shown in FIG. 9) being transmitted to at least one of the rollers 31 and 32, which the belt 33 is set around, and the recording paper 16 held on the belt 33 is conveyed from left to right in FIG. 1.

Since ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not shown, examples thereof include a configuration in which the belt 33 is nipped with cleaning rollers such as a brush roller and a water absorbent roller, an air blow configuration in which clean air is blown onto the belt 33, or a combination of these. In the case of the configuration in which the belt 33 is nipped with the cleaning rollers, it is preferable to make the line velocity of the cleaning rollers different than that of the belt 33 to improve the cleaning effect.

The inkjet recording apparatus 10 can comprise a roller nip conveyance mechanism, in which the recording paper 16 is pinched and conveyed with nip rollers, instead of the suction belt conveyance unit 22. However, there is a drawback in the roller nip conveyance mechanism that the print tends to be smeared when the printing area is conveyed by the roller nip action because the nip roller makes contact with the printed surface of the paper immediately after printing. Therefore, the suction belt conveyance in which nothing comes into contact with the image surface in the printing area is preferable.

A heating fan 40 is disposed on the upstream side of the printing unit 12 in the conveyance pathway formed by the suction belt conveyance unit 22. The heating fan 40 blows heated air onto the recording paper 16 to heat the recording paper 16 immediately before printing so that the ink deposited on the recording paper 16 dries more easily.

Figure 2:
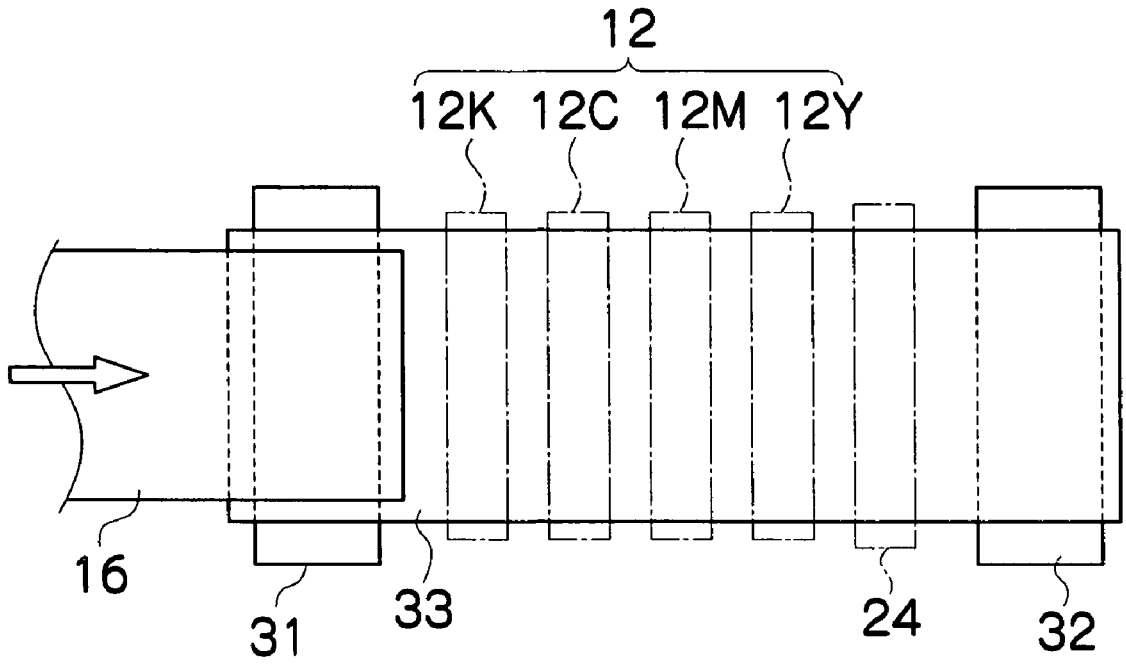
FIG. 2 is a plan view of the principal part of the peripheral area of a print unit in the inkjet recording apparatus shown in FIG. 1.

The heads 12K, 12C, 12M and 12Y of the printing unit 12 are full line heads having a length corresponding to the maximum width of the recording paper 16 used with the inkjet recording apparatus 10, and comprising a plurality of nozzles for ejecting ink arranged on a nozzle face through a length exceeding at least one edge of the maximum-size recording medium (namely, the full width of the printable range) (see FIG. 2).

The print heads 12K, 12C, 12M and 12Y are arranged in color order (black (K), cyan (C), magenta (M), yellow (Y)) from the upstream side in the feed direction of the recording paper 16, and these respective heads 12K, 12C, 12M and 12Y are fixed extending in a direction substantially perpendicular to the conveyance direction of the recording paper 16.

A color image can be formed on the recording paper 16 by ejecting inks of different colors from the heads 12K, 12C, 12M and 12Y, respectively, onto the recording paper 16 while the recording paper 16 is conveyed by the suction belt conveyance unit 22.

By adopting a configuration in which the fill line heads 12K, 12C, 12M and 12Y having nozzle rows covering the full paper width are provided for the respective colors in this way, it is possible to record an image on the full surface of the recording paper 16 by performing just one operation of relatively moving the recording paper 16 and the printing unit 12 in the paper conveyance direction (the sub-scanning direction), in other words, by means of a single sub-scanning action. Higher-speed printing is thereby made possible and productivity can be improved in comparison with a shuttle type head configuration in which a recording head reciprocates in the main scanning direction.

Although the configuration with the KCMY four standard colors is described in the present embodiment, combinations of the ink colors and the number of colors are not limited to those. Light inks, dark inks or special color inks can be added as required. For example, a configuration is possible in which inkjet heads for ejecting light-colored inks such as light cyan and light magenta are added. Furthermore, there are no particular restrictions of the sequence in which the heads of respective colors are arranged.

The print determination unit 24 shown in FIG. 1 has an image sensor for capturing an image of the ink-droplet deposition result of the printing unit 12, and functions as a device to check for ejection defects such as clogs of the nozzles and deposition position displacement from the ink-droplet deposition image read by the image sensor.

The print determination unit 24 of the present embodiment is configured with at least a line sensor having rows of photoelectric transducing elements with a width that is greater than the ink-droplet ejection width (image recording width) of the heads 12K, 12C, 12M, and 12Y. This line sensor has a color separation line CCD sensor including a red (R) sensor row composed of photoelectric transducing elements (pixels) arranged in a line provided with an R filter, a green (G) sensor row with a G filter, and a blue (B) sensor row with a B filter. Instead of a line sensor, it is possible to use an area sensor composed of photoelectric transducing elements which are arranged two-dimensionally.

A test pattern or the target image printed by the print heads 12K, 12C, 12M, and 12Y of the respective colors is read in by the print determination unit 24, and the ejection performed by each head is determined. The ejection determination includes detection of the ejection, measurement of the dot size, and measurement of the dot formation position.

A post-drying unit 42 is disposed following the print determination unit 24. The post-drying unit 42 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming contact with ozone and other substance that cause dye molecules to break down, and has the effect of increasing the durability of the print.

A heating/pressurizing unit 44 is disposed following the post-drying unit 42. The heating/pressurizing unit 44 is a device to control the glossiness of the image surface, and the image surface is pressed with a pressure roller 45 having a predetermined uneven surface shape while the image surface is heated, and the uneven shape is transferred to the image surface.

The printed matter generated in this manner is outputted from the paper output unit 26. The target print (i.e., the result of printing the target image) and the test print are preferably outputted separately. In the inkjet recording apparatus 10, a sorting device (not shown) is provided for switching the outputting pathways in order to sort the printed matter with the target print and the printed matter with the test print, and to send them to paper output units 26A and 26B, respectively. When the target print and the test print are simultaneously formed in parallel on the same large sheet of paper, the test print portion is cut and separated by a cutter (second cutter) 48. The cutter 48 is disposed directly in front of the paper output unit 26, and is used for cutting the test print portion from the target print portion when a test print has been performed in the blank portion of the target print. The structure of the cutter 48 is the same as the first cutter 28 described above, and has a stationary blade 48A and a round blade 48B.

Although not shown in FIG. 1, the paper output unit 26A for the target prints is provided with a sorter for collecting prints according to print orders.

Structure of Head

Next, the structure of a head will be described. The heads 12K, 12C, 12M and 12Y of the respective ink colors have the same structure, and a reference numeral 50 is hereinafter designated to any of the heads.

Figure 3A:
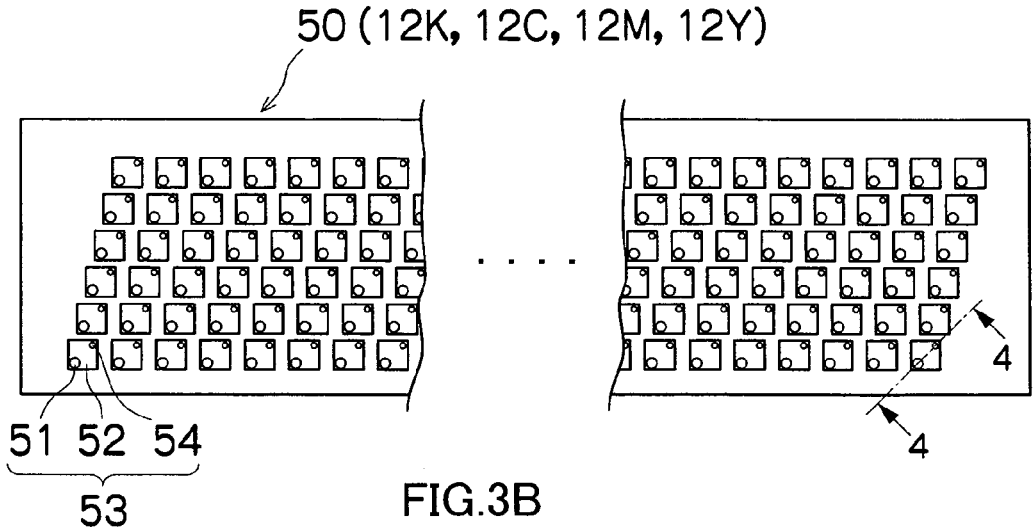
FIG. 3A is a perspective plan view showing an example of the composition of a print head.
Figure 3B:
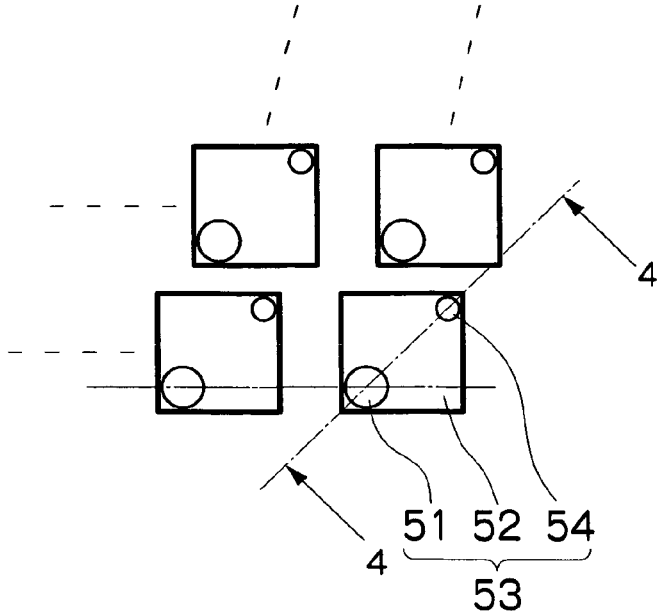
FIG. 3B is a principal enlarged view of FIG. 3A.
Figure 3C:
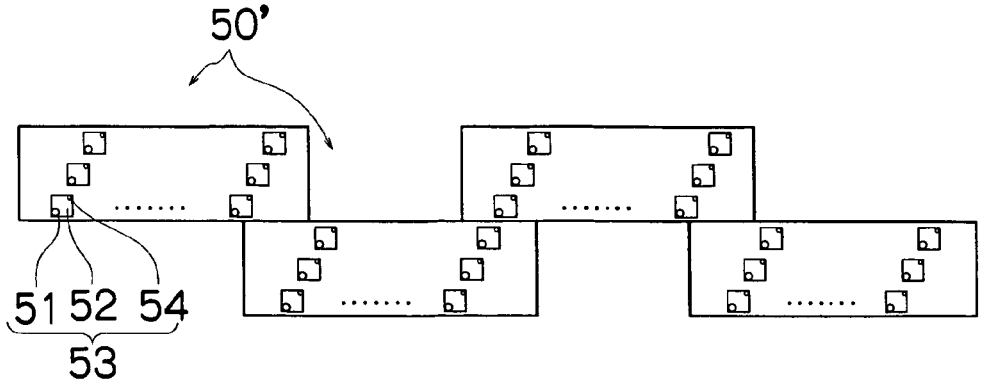
FIG. 3C is a perspective plan view showing another example of the configuration of a full line head.
Figure 4:
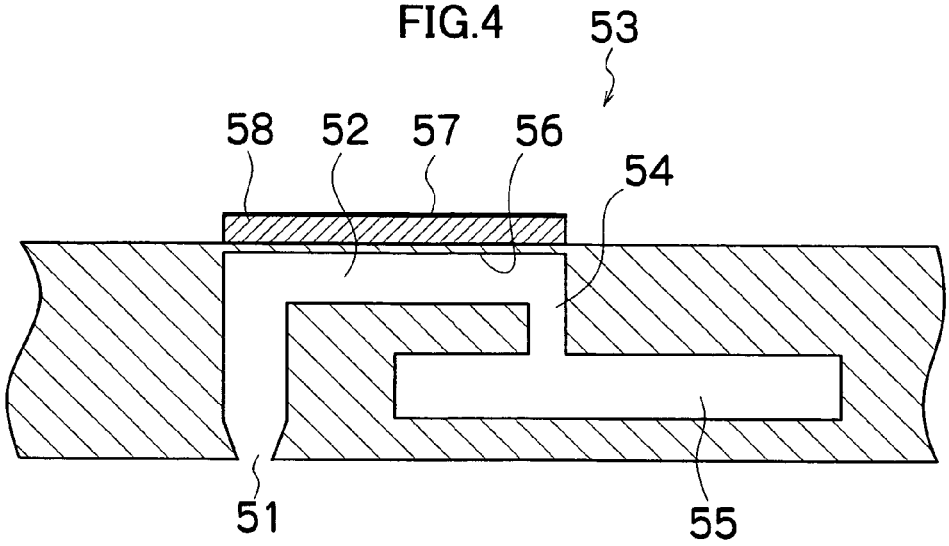
FIG. 4 is a cross-sectional view along line 4-4 in FIG. 3A.

FIG. 3A is a perspective plan view showing an example of the configuration of the head 50, FIG. 3B is an enlarged view of a portion thereof, FIG. 3C is a perspective plan view showing another example of the configuration of the head 50, and FIG. 4 is a cross-sectional view taken along the line 4-4 in FIG. 3A, showing the inner structure of a droplet ejection element (an ink chamber unit for one nozzle 51).

The nozzle pitch in the head 50 should be minimized in order to maximize the density of the dots printed on the surface of the recording paper 16. As shown in FIGS. 3A and 3B, the head 50 according to the present embodiment has a structure in which a plurality of ink chamber units (droplet ejection elements) 53, each comprising a nozzle 51 forming an ink droplet ejection port, a pressure chamber 52 corresponding to the nozzle 51, and the like, are disposed two-dimensionally in the form of a staggered matrix, and hence the effective nozzle interval (the projected nozzle pitch) as projected in the lengthwise direction of the head (the direction perpendicular to the paper conveyance direction) is reduced and high nozzle density is achieved.

The mode of forming one or more nozzle rows through a length corresponding to the entire width of the recording paper 16 in a direction substantially perpendicular to the conveyance direction of the recording paper 16 is not limited to the example described above. For example, instead of the configuration in FIG. 3A, as shown in FIG. 3C, a line head having nozzle rows of a length corresponding to the entire width of the recording paper 16 can be formed by arranging and combining, in a staggered matrix, short head blocks 50' having a plurality of nozzles 51 arrayed in a two-dimensional fashion.

As shown in FIGS. 3A to 3C, the planar shape of the pressure chamber 52 provided for each nozzle 51 is substantially a square, and the nozzle 51 and an inlet for supplied ink (supply port) 54 are disposed in both corners on a diagonal line of the square. The shape of the pressure chamber 52 is not limited to that of the present embodiment and various modes are possible in which the planar shape is a diamond shape, a rectangular shape, a pentagonal shape, a hexagonal shape, or other polygonal shape, or a circular shape, elliptical shape, or the like.

As shown in FIG. 4, each pressure chamber 52 is connected to a common channel 55 through the supply port 54. The common channel 55 is connected to an ink tank 60 (not shown in FIG. 4, but shown in FIG. 6), which is a base tank that supplies ink, and the ink supplied from the ink tank 60 is delivered through the common flow channel 55 in FIG. 4 to the pressure chambers 52.

An actuator 58 provided with an individual electrode 57 is bonded to a pressure plate 56 (a diaphragm that also serves as a common electrode) which forms the ceiling of the pressure chamber 52. When a drive voltage is applied to the individual electrode 57, the actuator 58 is deformed, the volume of the pressure chamber 52 is thereby changed, and the pressure in the pressure chamber 52 is thereby changed, so that the ink inside the pressure chamber 52 is thus ejected through the nozzle 51. The actuator 58 is preferably a piezoelectric element. When ink is ejected, new ink is supplied to the pressure chamber 52 from the common flow channel 55 through the supply port 54.

Figure 5:
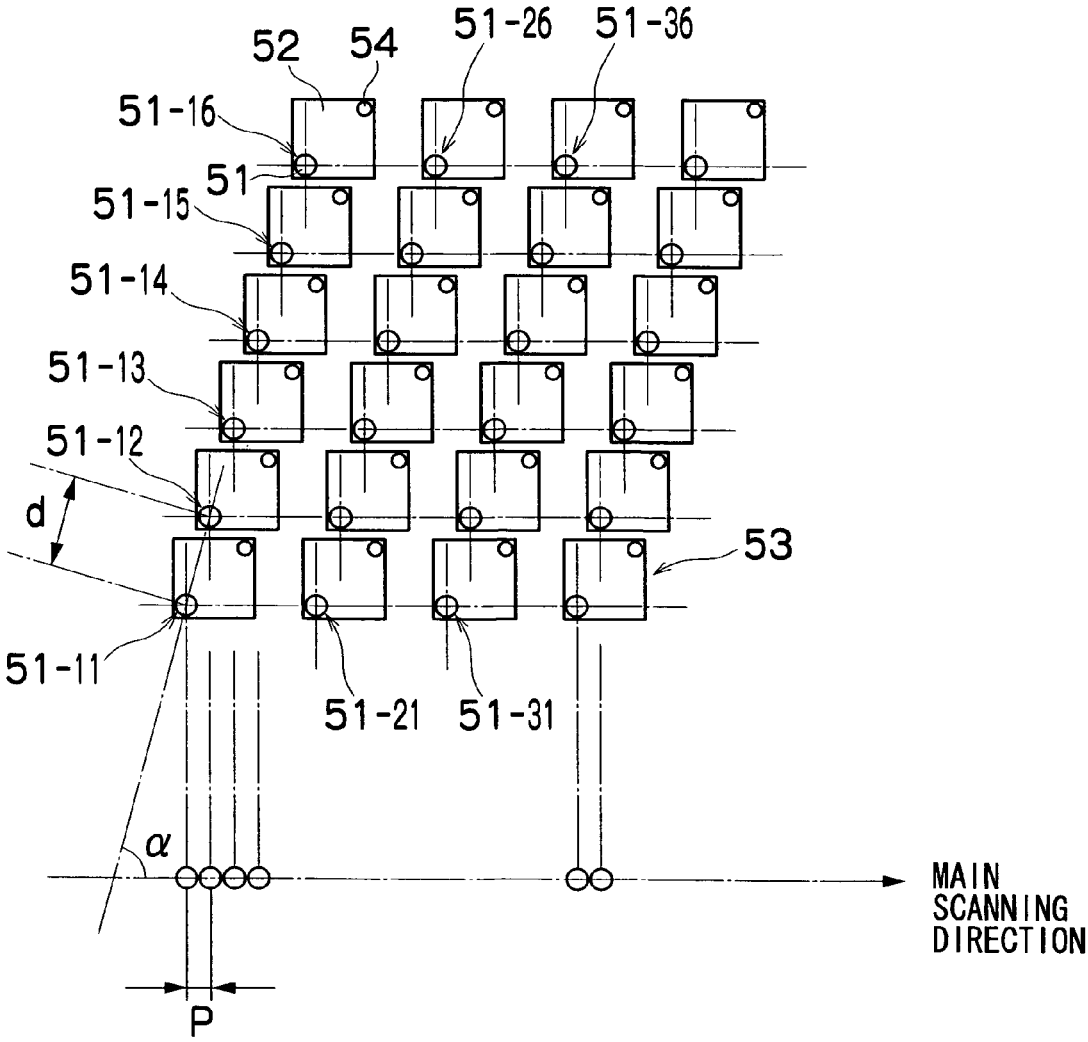
FIG. 5 is an enlarged view showing a nozzle arrangement in the print head shown in FIG. 3A.

As shown in FIG. 5, the high-density nozzle head according to the present embodiment is achieved by arranging a plurality of ink chamber units 53 having the above-described structure in a lattice fashion based on a fixed arrangement pattern, in a row direction which coincides with the main scanning direction, and a column direction which is inclined at a fixed angle of $\alpha$ with respect to the main scanning direction, rather than being perpendicular to the main scanning direction.

More specifically, by adopting a structure in which a plurality of ink chamber units 53 are arranged at a uniform pitch d in line with a direction forming an angle of a with respect to the main scanning direction, the pitch P of the nozzles projected so as to align in the main scanning direction is $d \times \cos \alpha$, and hence the nozzles 51 can be regarded to be equivalent to those arranged linearly at a fixed pitch P along the main scanning direction. Such configuration results in a nozzle structure in which the nozzle row projected in the main scanning direction has a high nozzle density of up to 2,400 nozzles per inch.

In a full-line head comprising rows of nozzles that have a length corresponding to the entire width of the image recordable width, the "main scanning" is defined as printing one line (a line formed of a row of dots, or a line formed of a plurality of rows of dots) in the width direction of the recording paper (the direction perpendicular to the conveyance direction of the recording paper) by driving the nozzles in one of the following ways: (1) simultaneously driving all the nozzles; (2) sequentially driving the nozzles from one side toward the other; and (3) dividing the nozzles into blocks and sequentially driving the nozzles from one side toward the other in each of the blocks.

In particular, when the nozzles 51 arranged in a matrix such as that shown in FIG. 5 are driven, the main scanning according to the above-described (3) is preferred. More specifically, the nozzles 51-11, 51-12, 51-13, 51-14, 51-15 and 51-16 are treated as a block (additionally; the nozzles 51-21, . . . , 51-26 are treated as another block; the nozzles 5151-31, . . . , 51-36 are treated as another block; . . . ); and one line is printed in the width direction of the recording paper 16 by sequentially driving the nozzles 51-11, 51-12, . . . , 51-16 in accordance with the conveyance velocity of the recording paper 16.

On the other hand, "sub-scanning" is defined as to repeatedly perform printing of one line (a line formed of a row of dots, or a line formed of a plurality of rows of dots) formed by the main scanning, while moving the full-line head and the recording paper relatively to each other.

In implementing the present invention, the arrangement of the nozzles is not limited to that of the example illustrated. Moreover, a method is employed in the present embodiment where an ink droplet is ejected by means of the deformation of the actuator 58, which is typically a piezoelectric element; however, in implementing the present invention, the method used for discharging ink is not limited in particular, and instead of the piezo jet method, it is also possible to apply various types of methods, such as a thermal jet method where the ink is heated and bubbles are caused to form therein by means of a heat generating body such as a heater, ink droplets being ejected by means of the pressure applied by these bubbles.

Composition of Ink Supply System

Figure 6:
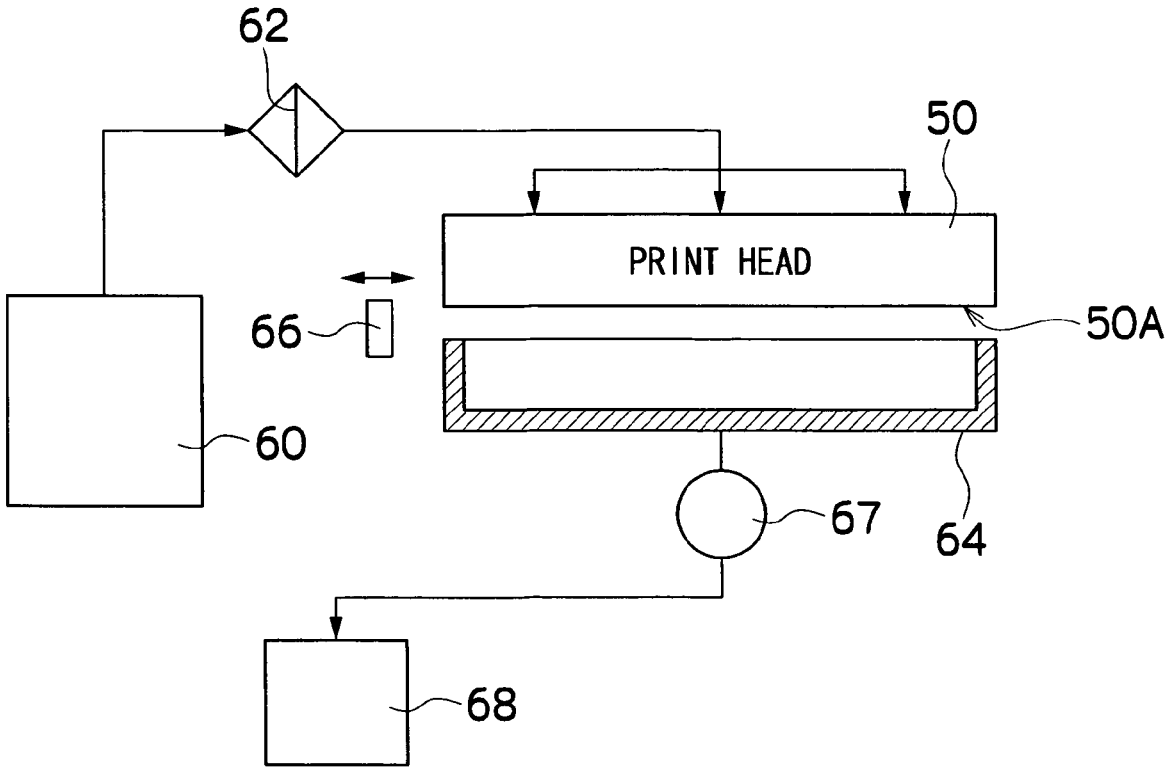
FIG. 6 is a schematic drawing showing the configuration of an ink supply system in the inkjet recording apparatus.

FIG. 6 is a conceptual diagram showing the composition of an ink supply system in the inkjet recording apparatus 10. In FIG. 6, the ink tank 60 is a base tank for supplying ink to the print head 50, which is disposed in the ink storing and loading unit 14 shown in FIG. 1. In other words, the ink supply tank 60 in FIG. 6 is equivalent to the ink storing and loading unit 14 in FIG. 1. The ink tank 60 may adopt a system for replenishing ink by means of a replenishing port (not shown), or a cartridge system in which cartridges are exchanged independently for each tank, whenever the residual amount of ink has become low. If the type of ink is changed in accordance with the type of application, then a cartridge based system is suitable. In this case, desirably, type information relating to the ink is identified by means of a bar code, or the like, and the ejection of the ink is controlled in accordance with the ink type.

A filter 62 for removing foreign matters and bubbles is disposed between the ink tank 60 and the head 50 as shown in FIG. 6. The filter mesh size in the filter 62 is preferably equivalent to or less than the diameter of the nozzle and commonly about 20 μm. Although not shown in FIG. 6, it is preferable to provide a sub-tank integrally to the print head 50 or nearby the head 50. The sub-tank has a damper function for preventing variation in the internal pressure of the head and a function for improving refilling of the print head.

The inkjet recording apparatus 10 is also provided with a cap 64 as a device to prevent the nozzles 51 from drying out or to prevent an increase in the ink viscosity in the vicinity of the nozzles 51, and a cleaning blade 66 as a device to clean the nozzle face 50A. A maintenance unit including the cap 64 and the cleaning blade 66 can be relatively moved with respect to the head 50 by a movement mechanism (not shown), and is moved from a predetermined holding position to a maintenance position below the head 50 as required.

The cap 64 is displaced up and down relatively with respect to the head 50 by an elevator mechanism (not shown). When the power of the inkjet recording apparatus 10 is turned OFF or when in a print standby state, the cap 64 is raised to a predetermined elevated position so as to come into close contact with the head 50, and the nozzle face 50A is thereby covered with the cap 64.

The cleaning blade 66 is composed of rubber or another elastic member, and can slide on the ink ejection surface (surface of the nozzle plate) of the head 50 by means of a blade movement mechanism (not shown). When ink droplets or foreign matter has adhered to the nozzle plate, the surface of the nozzle plate (the nozzle face 50A) is wiped and cleaned by sliding the cleaning blade 66 on the nozzle plate.

During printing or standby, when the frequency of use of specific nozzles is reduced and ink viscosity increases in the vicinity of the nozzles, a preliminary discharge is made to eject the degraded ink toward the cap 64.

Also, when bubbles have become intermixed in the ink inside the head 50 (inside the pressure chamber 52), the cap 64 is placed on the head 50, the ink inside the pressure chamber 52 (the ink in which bubbles have become intermixed) is removed by suction with a suction pump 67, and the suction-removed ink is sent to a collection tank 68. This suction action entails the suctioning of degraded ink of which viscosity has increased (hardened) also when initially loaded into the head 50, or when service has started after a long period of being stopped.

When a state in which ink is not ejected from the head 50 continues for a certain amount of time or longer, the ink solvent in the vicinity of the nozzles 51 evaporates and ink viscosity increases. In such a state, ink can no longer be ejected from the nozzle 51 even if the actuator 58 for the ejection driving is operated. Before reaching such a state (in a viscosity range that allows ejection by the operation of the actuator 58) the actuator 58 is operated to perform the preliminary discharge to eject the ink of which viscosity has increased in the vicinity of the nozzle toward the ink receptor. After the nozzle surface is cleaned by a wiper such as the cleaning blade 66 provided as the cleaning device for the nozzle face 50A, a preliminary discharge is also carried out in order to prevent the foreign matter from becoming mixed inside the nozzles 51 by the wiper sliding operation. The preliminary discharge is also referred to as "dummy discharge", "purge", "liquid discharge", and so on.

When bubbles have become intermixed in the nozzle 51 or the pressure chamber 52, or when the ink viscosity inside the nozzle 51 has increased over a certain level, ink can no longer be ejected by the preliminary discharge, and a suctioning action is carried out as follows.

More specifically, when bubbles have become intermixed in the ink inside the nozzle 51 and the pressure chamber 52 or the viscosity of ink in the nozzle 51 reaches a certain level or more, ink can no longer be ejected from the nozzle 51 even if the actuator 58 is operated. In cases of this kind, a suctioning device (the cap 64 in FIG. 6) for suctioning ink inside the pressure chamber 52 by means of a pump, or the like, abuts against the nozzle surface 50A of the print head 50, and an operation for suctioning the ink containing an air bubble, or the ink of increased viscosity, is carried out. However, since the suctioning operation is performed with respect to all of the ink in the pressure chambers 52, it consumes a large amount of ink, and therefore, desirably, preliminary ejection is carried out while the increase in the viscosity of the ink is still minor.

Ejection Timing Control Method

Here, an example of a droplet ejection method (ejection timing control method) for restricting decline in line quality caused by an ejection direction abnormality (in other words, deposition position displacement) in a nozzle, will be described.

Figure 7:
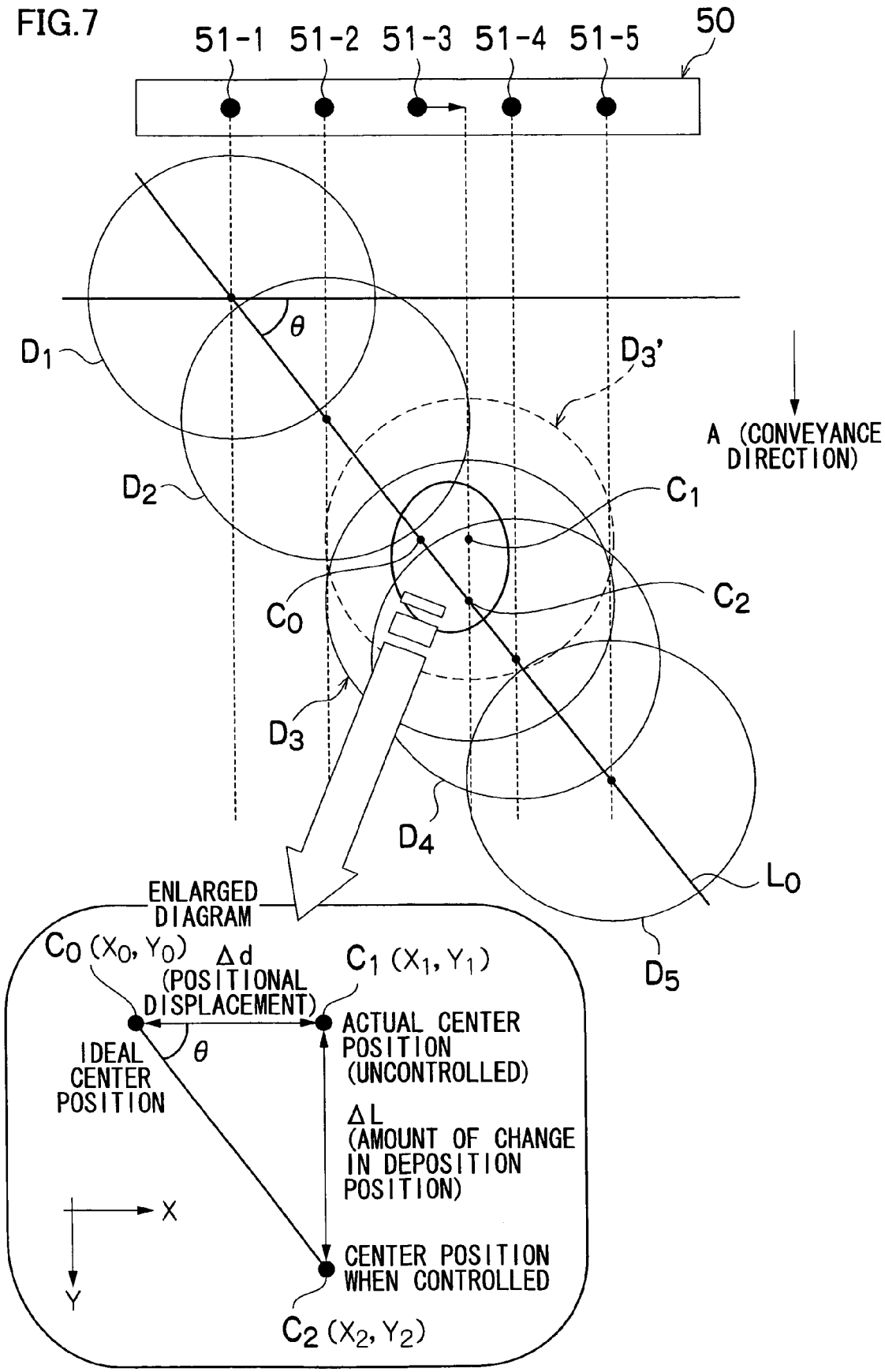
FIG. 7 is a schematic drawing for describing an example of control of ejection timing according to the present embodiment.
Figure 17B:
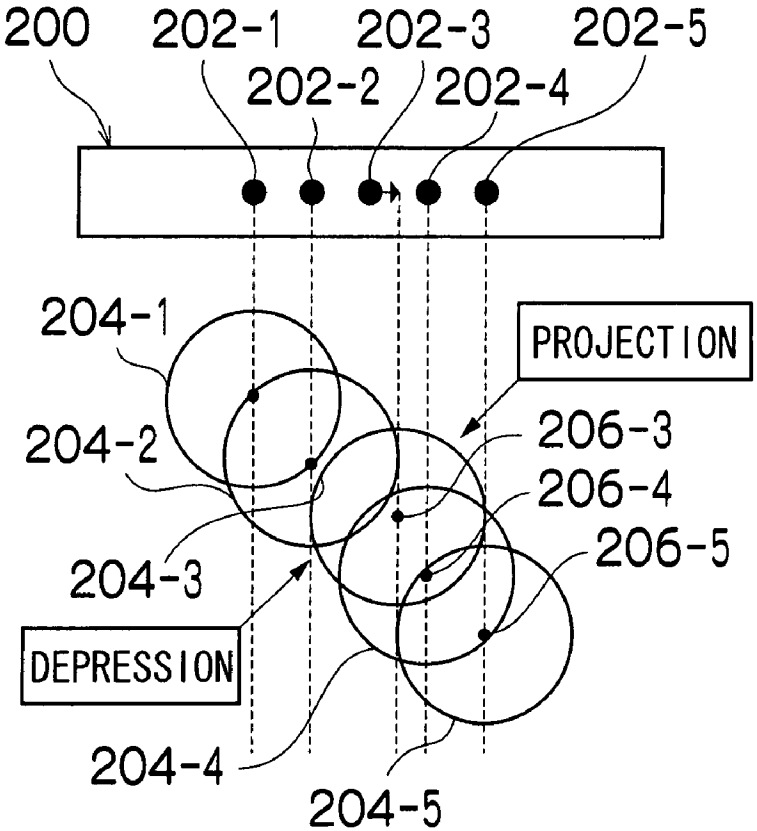
FIGS. 17A and 17B are schematic drawings for describing the phenomenon of reduced line quality caused by an ejection direction abnormality from a nozzle.
Figure 17A:
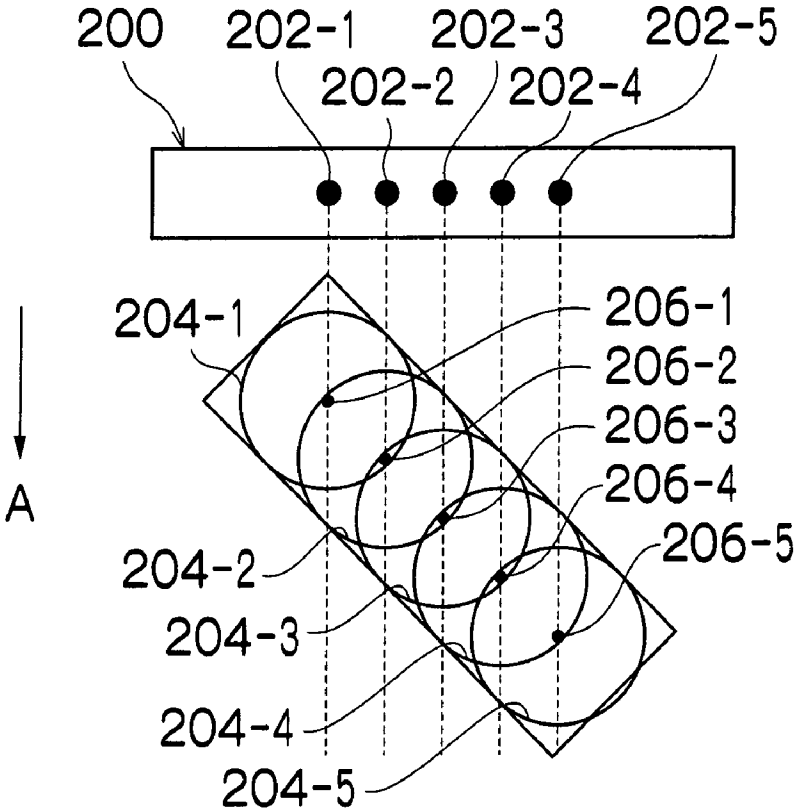

In order to facilitate comparison with FIGS. 17A and 17B, the description here refers to the schematic drawing in FIG. 7. FIG. 7 shows a state where five nozzles 51-*i* (i=1, 2, 3, 4, 5) are arranged in one row, and it shows a portion of the equivalent nozzle row obtained when the nozzles of the matrix arrangement described in FIG. 3A to FIG. 5 are projected to a line in the main scanning direction.

In FIG. 7, the central nozzle 51-3 is a defective nozzle (a nozzle suffering an ejection direction abnormality), and the flight direction of the ink ejected from this nozzle 51-3 is displaced in the rightward direction in the nozzle row direction. More specifically, the actual deposition center position $C_1$, which is the center position of a deposited droplet when the droplet is ejected without corrective control (hereinafter referred to as the "uncontrolled center position"), is shifted toward the right with respect to the ideal deposition center position $C_0$ in a case where it is supposed that the nozzle 51-3 is ejecting normally.

Therefore, if an oblique line such as that shown in FIG. 7 is formed by carrying out a normal ejection operation (without corrective control), then a droplet ejected from nozzle 51-3 is deposited at the position indicated by the dotted circle $D_3'$ in FIG. 7, thus leading to deterioration in line quality (see FIGS. 17A and 17B). Therefore, in the present embodiment, as shown by the solid circle $D_3$ in FIG. 7, the ejection timing of the defective nozzle 51-3 is corrected, and a droplet is ejected in such a manner that the deposition center position $C_2$ after corrective control (hereinafter referred to as the "controlled center position") lies on the ideal line $L_0$. Here, the "ideal line" is a line which links the centers of the dots when it is assumed that there is no deposition position displacement at all in any of the nozzles (in other words, the original dots which are to be formed on the recording medium as calculated from the image data). The line linking the centers of the dots may be a curved line rather than a straight line, but in practical terms, it is sufficient to use a straight line interpolated between the dot centers.

Consequently, as shown in FIG. 7, the dots Di (i=1, 2, 3, 4, 5) deposited by the nozzles 51-*i* (i=1, 2, 3, 4, 5) are situated on a single straight line following the ideal line $L_0$, and the depressions and projections in the line are prevented.

More specifically, control is implemented in the following manner. As shown by the partial enlarged diagram in FIG. 7, if the amount of deposition position displacement in the main scanning direction of the uncontrolled center position $C_1$ with respect to the ideal deposition center position $C_0$ is taken to be Δd, the distance in the sub-scanning direction from the uncontrolled center position $C_1$ to the ideal line $L_0$ (in other words, the amount of change in the deposition position from the uncontrolled center position $C_1$ to the controlled center position $C_2$ on the ideal line $L_0$, which is separated from $C_1$ in the sub-scanning direction), to be ΔL, and the conveyance speed (relative movement speed) of the recording medium (recording paper 16), to be V, then the amount of change in the ejection timing (the correction time of the ejection timing) Δt, is given as:

$$\Delta t=\Delta L/V. \tag{1}$$

In FIG. 7, a coordinates system is introduced, taking the nozzle row direction (main scanning direction) as the X axis and the recording medium conveyance direction (sub-scanning direction) perpendicular to the main scanning direction as the Y axis. The ideal deposition center position $C_0$ is taken to be $(X_0, Y_0)$, the uncontrolled center position $C_1$ is taken to be $(X_1, Y_1)$, and the controlled center position $C_2$ is taken to be $(X_2, Y_2)$. Furthermore, taking the function indicating the ideal line $L_0$ to be Y=f(X), the amount of change in the deposition position, ΔL, is given as:

$$\Delta L=Y_2-Y_1=f(X_1)-Y_1. \tag{2}$$

Then, from the equations (1) and (2), it is possible to express the amount of change in the ejection timing (the correction time of the ejection timing) Δt as:

$$\Delta t=(Y_2-Y_1)/V=(f(X_1)-Y_1)/V. \tag{3}$$

Furthermore, if the ideal line $L_0$ of the segment that is to be printed is limited to a straight line, then using the angle θ of this ideal line $L_0$ from the nozzle row direction (the main scanning direction), it is possible to express the amount of change in the deposition position, ΔL as:

$$\Delta L=\Delta d\times\tan\theta. \tag{4}$$

Therefore, the amount of change in the ejection timing Δt in the equation (1) can be expressed as:

$$\Delta t=\Delta L/V=(\Delta d\times\tan\theta)/V. \tag{5}$$

The ejection timing of the defective nozzle (nozzle 51-3 in FIG. 7) is adjusted on the basis of the amount of change of the ejection timing, Δt, thus determined.

As can be seen from the equation (4), if θ=0° or 90°, then special conditions apply, and such cases may be excluded from the argument described above.

Furthermore, a case is now described in which the droplet ejection correction method described above is implemented in the inkjet recording apparatus 10 according to the present embodiment, following the sequence of the method.

(Step 1) Firstly, the inkjet recording apparatus 10 obtains information for the amount of deposition position displacement (=Δd) in the nozzle row direction (the main scanning direction, which is perpendicular to the paper conveyance direction) of the nozzles 51 of the print head 50, and this data is stored previously in a storage device (EEPROM, or the like) in the apparatus. The method of measuring (inferring) and storing the amount of deposition position displacement can be: (1) a method whereby a test print is created without implementing corrective control and then the actual dot positions are read in; or (2) a method whereby an image is captured of the liquid droplets in flight, and the droplet deposition positions are determined (inferred) from these positions by calculation; or the like. In the inkjet recording apparatus 10, desirably, a device for measuring (or inferring) the amount of deposition position displacement of each of the nozzles is provided. In the embodiment shown in FIG. 1, it is possible to read in the dot positions from the print results of a test print, using the print determination unit 24.

Figure 8A:
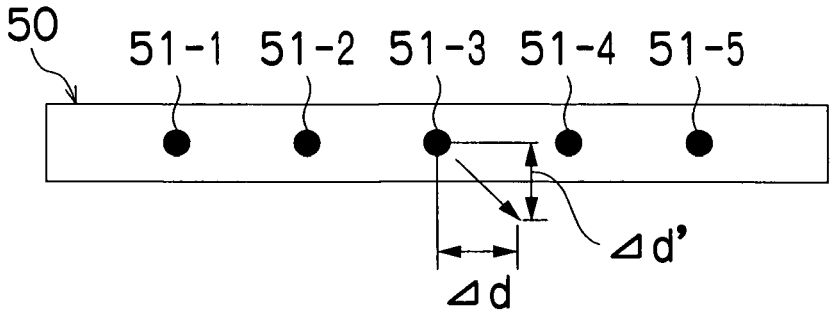
FIGS. 8A and 8B are schematic drawings for describing an example of control in a case where the deposition position displacement Δd' in the sub-scanning direction is taken into account.

Furthermore, the timing at which the amount of deposition position displacement is determined can be: (a) when the inkjet recording apparatus 10 is inspected for shipment; (b) after purchase of the apparatus and before using it for the first time; (c) after switching off the power supply and before performing the first print operation when it is next switched on; (d) after wiping the nozzle surface; (e) during actual printing of an image; or the like. In FIG. 7, the description relates to deposition position displacement in the nozzle row direction (main scanning direction) only, but as shown in FIG. 8A, desirably, the deposition position displacement, Δd', in the sub-scanning direction is also simultaneously read in.

(Step 2) Line figure data ("line data") such a line in a figure or graph, text characters, or the boundary line between regions of different colors, is recognized from the image data for printing (for example, dot data generated from the original image data), and an ideal line is determined for the data corresponding to that line figure. The ideal line can be found in a format (A): a function equation or a set of equations for the position (point) data of the dot row; or a format (B): an angle θ of each of the lines from the nozzle row direction.

Figure 8B:
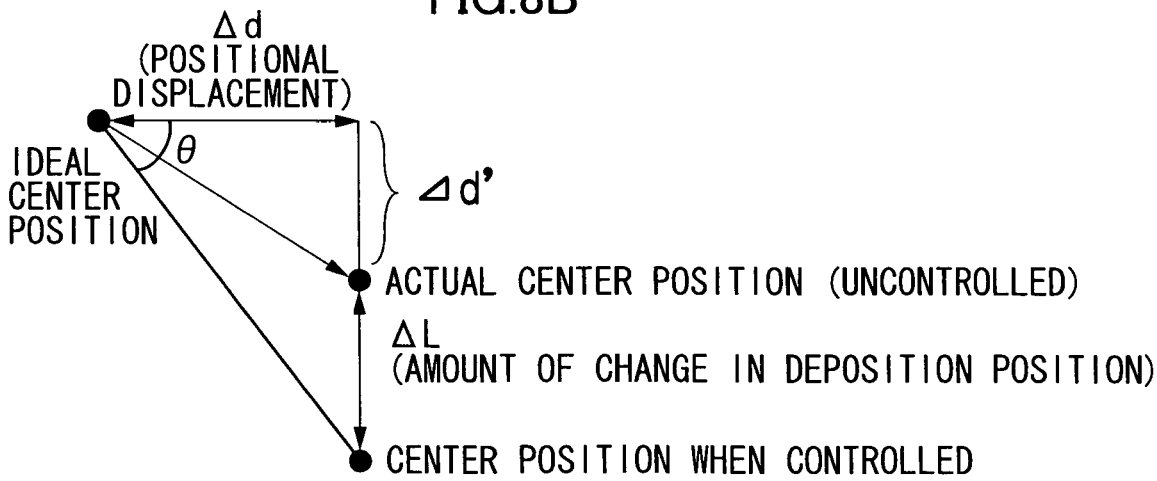

(Step 3) From the results in the steps 1 and 2, the amount of change in the deposition position (=ΔL) of each nozzle is determined. More specifically, if the ideal line is defined in terms of the format (A) described above in the step 2, then the difference in the sub-scanning direction between the ideal line and the deposition center position of the dot which is actually expected (in other words, the uncontrolled center position) is taken to be ΔL. On the other hand, if the ideal line is defined in terms of the format (B) in the step 2, then from the equation (4), ΔL=Δd×tan θ. If there is a deposition position displacement of Δd' in the sub-scanning direction also, then ΔL=Δd×tan θ−Δd' (see FIG. 8B).

(Step 4) From the results in the step 3, the correction time (=Δt) for the ejection timing of each nozzle is determined. More specifically, as indicated in the equation (5), Δt=ΔL/V=(Δd×tan θ)/V. Here, if the deposition position displacement in the sub-scanning direction, Δd', is also determined, then the following equation (6) is obtained:

$$\Delta t=\Delta L/V=(\Delta d\times\tan\theta-\Delta d')/V. \tag{6}$$

(Step 5) Each of the ejection timings of the nozzles is shifted by the correction time Δt for the ejection timing determined in the step 4, and ejection is performed. Thereby, it is possible to prevent decline in line quality, without causing the dots to be deposited at their ideal positions.

This system may also be constituted as described in modification examples 1 to 3 described below.

(Modification example 1) If the ejection timings can only be discretely shifted, then shift amounts for the ejection timings are set, as $\Delta t_0, \Delta t_1, \ldots, \Delta t_n$, and the discrete value nearest to the value of Δt found in the calculation step for Δt=ΔL/V (in step 4), is used.

(Modification example 2) If performing the aforementioned calculation for any angle θ places a large burden on the system, then the angle θ of the oblique line is classified into a plurality of levels (steps), such as $\theta_0, \theta_1, \ldots, \theta_n$, and values of tan $\theta_j$ are previously prepared to the respective discrete angles $\theta_j$(j=0, 1, 2, . . . , n). It is judged which of the discrete angles $\theta_0, \theta_1, \ldots, \theta_n$ is closest to the angle of the line to be outputted, and a calculation is performed to determine the ejection timing correction time ($\Delta t$), using the prepared tangent value corresponding to the closest discrete angle.

(Modification example 3) If the task of correcting the ejection timing as described above for all of the nozzles places a large burden on the system, then the ejection timing is corrected only in respect of nozzles for which the amount of deposition position displacement, $\Delta d$, found at the step 1 exceeds a prescribed threshold value, $\Delta d_{th}$. Desirably, the value of the threshold value, $\Delta d_{th}$, which provides a reference for determining whether or not to perform correction processing, is set to the minimum value at which decline in line quality (and in particular, depressions and projections in the line due to deposition position displacement) become readily visible. The value of $\Delta d_{th}$ may also be set differently for respective angles $\theta$ of the ideal line.

It is possible to avoid placing excessive burden on the system by omitting to perform correction in cases where there is only a minimal level of deposition position displacement which will not be visible. In this case, a mode is possible in which information relating to amounts of deposition position displacement which do not reach the threshold value $\Delta d_{th}$ are not stored at the stage of storing the amount of deposition position displacement for each nozzle, or a mode is also possible in which all of the displacement information is recorded at the stage of storing the amounts of deposition position displacement, regardless of the size of the displacement with respect to the threshold value, whereupon the amount of displacement is compared with the threshold value at the stage of implementing corrective calculation, and amounts to be corrected are selected, accordingly.

Description of Control System

Next, the system composition of the inkjet recording apparatus 10 according to the present embodiment will be described.

Figure 9:
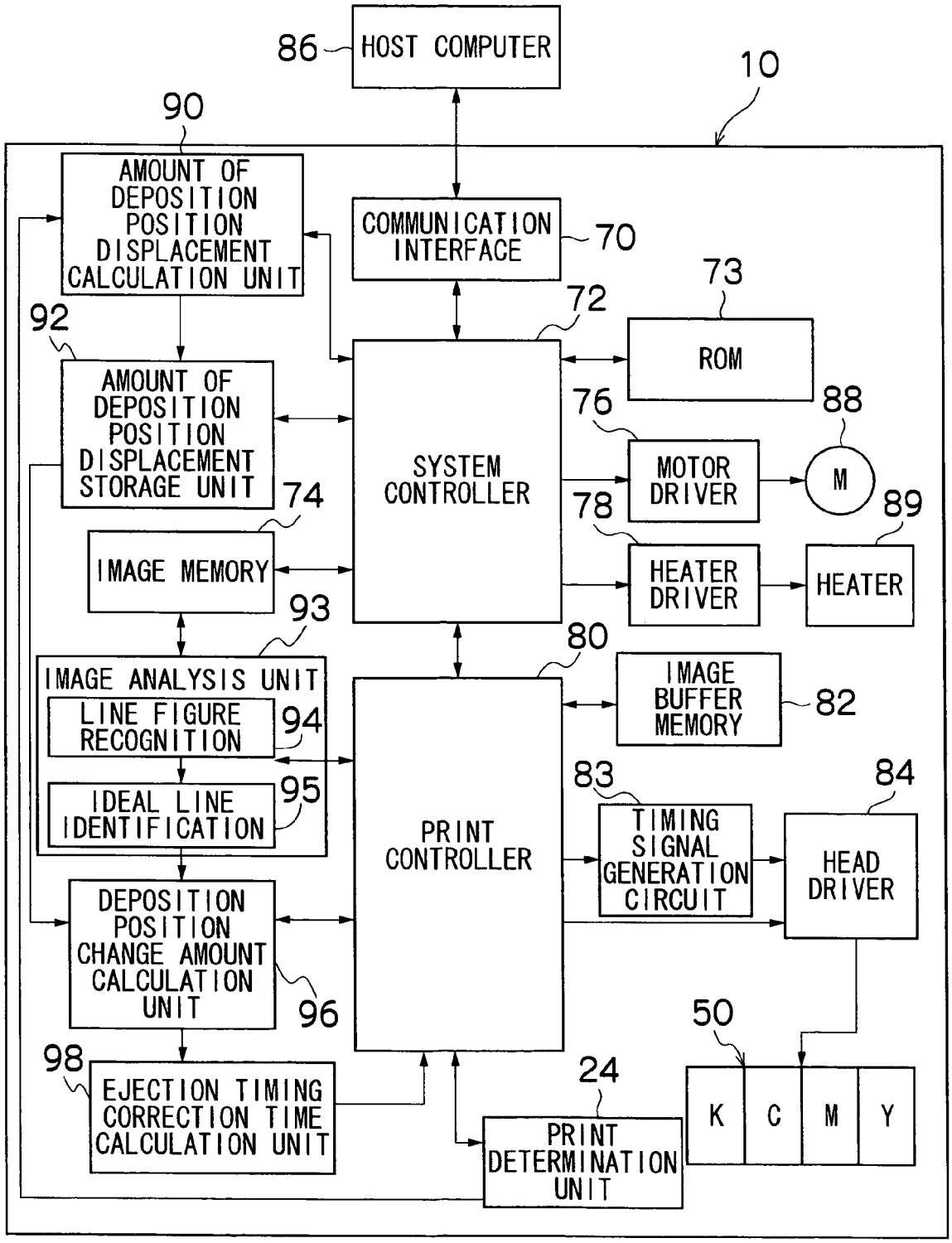
FIG. 9 is a principal block diagram showing the system composition of an inkjet recording apparatus according to the present embodiment.

FIG. 9 is a principal block diagram showing the system composition of the inkjet recording apparatus 10 according to the present embodiment. The inkjet recording apparatus 10 comprises a communications interface 70, a system controller 72, a ROM 73, an image memory 74, a motor driver 76, a heater driver 78, a print controller 80, an image buffer memory 82, a timing signal generation circuit 83, a head driver 84, and the like.

The communication interface 70 is an interface unit for receiving image data sent from a host computer 86. A serial interface such as USB, IEEE1394, Ethernet, wireless network, or a parallel interface such as a Centronics interface may be used as the communication interface 70. A buffer memory (not shown) may be mounted in this portion in order to increase the communication speed.

The image data sent from the host computer 86 is received by the inkjet recording apparatus 10 through the communication interface 70, and is temporarily stored in the image memory 74. The image memory 74 is a storage device for temporarily storing images inputted through the communication interface 70, and data is written and read to and from the image memory 74 through the system controller 72. The image memory 74 is not limited to a memory composed of semiconductor elements, and a hard disk drive or another magnetic medium may be used.

The system controller 72 is constituted by a central processing unit (CPU) and peripheral circuits thereof, and the like, and it functions as a control device for controlling the whole of the inkjet recording apparatus 10 in accordance with a prescribed program, as well as a calculation device for performing various calculations. More specifically, the system controller 72 controls the various sections, such as the communication interface 70, image memory 74, motor driver 76, heater driver 78, print controller 80, and the like, as well as controlling communications with the host computer 86 and writing and reading to and from the image memory 74, and it also generates control signals for controlling the motor 88 and heater 89 of the conveyance system.

The program executed by the CPU of the system controller 72 and the various types of data which are required for control procedures are stored in the ROM 73. The ROM 73 may be a non-writeable storage device, or it may be a rewriteable storage device, such as an EEPROM. The image memory 74 is used as a temporary storage region for the image data, and it is also used as a program development region and a calculation work region for the CPU.

The motor driver (drive circuit) 76 drives the motor 88 in accordance with commands from the system controller 72. The heater driver (drive circuit) 78 drives the heater 89 of the post-drying unit 42 or the like in accordance with commands from the system controller 72.

The print controller 80 has a signal processing function for performing various tasks, compensations, and other types of processing for generating print control signals from the image data (original image data) stored in the image memory 74 in accordance with commands from the system controller 72 so as to supply the generated print data (dot data) to the head driver 84.

Furthermore, the print controller 80 controls the ejection timings of the nozzles, and supplies control signals for generating prescribed timing signals, to the timing signal generation circuit 83. In other words, the print controller 80 corresponds to the "ejection timing control device" of the present invention. The timing signal generation circuit 83 outputs timing signals which specify the ejection timings, to the head driver 84, in accordance with instructions from the print controller 80.

The head driver 84 outputs drive signals for driving the actuators of the print heads of the respective colors, 12K, 12C, 12M, 12Y, on the basis of the print data supplied by the print controller 80 and the timing signals supplied by the timing signal generation circuit 83. A feedback control system for maintaining constant drive conditions for the print heads may be included in the head driver 84.

Prescribed signal processing is carried out in the print controller 80, and the ejection amount and the ejection timing of the ink droplets from the print head 50 are controlled via the head driver 84, on the basis of the generated dot data. By this means, prescribed dot size and dot positions can be achieved.

The print controller 80 is provided with the image buffer memory 82; and image data, parameters, and other data are temporarily stored in the image buffer memory 82 when image data is processed in the print controller 80. The aspect shown in FIG. 9 is one in which the image buffer memory 82 accompanies the print controller 80; however, the image memory 74 may also serve as the image buffer memory 82. Also possible is an aspect in which the print controller 80 and the system controller 72 are integrated to form a single processor.

In the composition shown in FIG. 9, to give a general description of the basic sequence of the print operation, image data to be printed (original image data) is input from an external source via a communications interface 70, and is accumulated in the image memory 74. At this stage, RGB image data is stored in the image memory 74, for example.

The image data stored in the image memory 74 is sent to the print controller 80 through the system controller 72, and is converted to the dot data for each ink color by a method (half-toning process), such as dithering or error diffusion, in the print controller 80. In other words, the print controller 80 performs processing for converting the input RGB image data into dot data for four colors, K, C, M and Y. The dot data generated by the print controller 80 is stored in the image buffer memory 82.

The head driver 84 outputs drive signals for driving the actuators 58 corresponding to the respective nozzles 51 of the print head 50, on the basis of the dot data stored in the image buffer memory 82 and the timing signals supplied by the timing signal generation circuit 83. By supplying the drive signals output by the head driver 84 to the print head 50, ink is ejected from the corresponding nozzles 51. By controlling ink ejection from the print heads 50 in synchronization with the conveyance speed of the recording paper 16, an image is formed on the recording paper 16.

In the present embodiment, a timing signal generation circuit 83 is provided between the print controller 80 and the head driver 84, as a device for altering the ejection timing. Alternatively, instead of this composition, it is also possible to provide a circuit which adjusts the application timing of the drive signal, such as a delay circuit, after the head driver 84 (between the head driver 84 and the print head 50). Furthermore, it is also possible to incorporate the timing signal generation circuit 83, the delay circuit, and the like, integrally, into the print controller 80 or head driver 84.

In addition to the composition described above, the inkjet recording apparatus 10 according to the present embodiment comprises a print determination unit 24, an amount of deposition position displacement calculation unit 90, an amount of deposition position displacement storage unit 92, an image analysis unit 93, a deposition position change amount calculation unit 96, an ejection timing correction time calculation unit 98, and the like.

As shown in FIG. 1, the print determination unit 24 is a block including a line sensor, which reads in the image printed onto the recording paper 16, performs various signal processing operations, and the like, and determines the print situation (presence/absence of ejection, variation in droplet ejection, etc.), these determination results being supplied to the print controller 80 and the amount of deposition position displacement calculation unit 90 in FIG. 9.

According to requirements, the print controller 80 makes various corrections with respect to the head 50 on the basis of information obtained from the print determination unit 24. Furthermore, the system controller 72 implements control for carrying out preliminary ejection, suctioning, and other prescribed restoring processes on the head 50, on the basis of the information obtained from the print determination unit 24.

The amount of deposition position displacement calculation unit 90 is a calculation processing unit which functions as a measurement device for measuring the amount of deposition position displacement from the ideal deposition position, for each nozzle, on the basis of the read results for a test print obtained by the print determination unit 24. It is also possible to incorporate the functions of the amount of deposition position displacement calculation unit 90 into the system controller 72.

The data for the amount of deposition position displacement measured by the amount of deposition position displacement calculation unit 90 is stored in the amount of deposition position displacement storage unit 92. Desirably, the amount of deposition position displacement storage unit 92 is constituted by a rewriteable non-volatile memory, such as an EEPROM. Furthermore, a mode is also possible in which a portion of the storage region of the ROM 73 is used as the amount of deposition position displacement storage unit 92.

The image analysis unit 93 is an image signal processing device comprising a line figure recognition processing unit 94 which recognizes line figures from the image data for printing (in the present embodiment, the dot data generated by the print controller 80) and an ideal line specification processing unit 95 which determines an ideal line for a line figure recognized by the line figure recognition processing unit 94. The technique for recognizing the line drawing from the image data and the technique used to extract the central line (ideal line) of the figure can be based on a conventional image signal processing technique, such as that described in Japanese Patent Application Publication No. 2001-357406, for example. For example, Japanese Patent Application Publication No. 2001-357406 discloses a method for recognizing line figures contained in a figure region, by performing vector conversion with respect to a figure region, and it describes core line processing for extracting the central line (core line) of the line width, and processing for converting this core line data into a vector.

In the present embodiment, a line figure is recognized by analyzing the dot data generated from the original image data, but in implementing the present invention, it is also possible to recognize line figures by analyzing the original image data (the input RGB image).

The deposition position change amount calculation unit 96 is a calculation unit which determines the amount of change in the sub-scanning direction in the deposition position of each nozzle, from the ideal line determined the ideal line specification processing unit 95 and the amount of deposition position displacement data stored in the amount of deposition position displacement storage unit 92. The information for the amounts of change in the deposition position thus calculated is supplied to the ejection timing correction time calculation unit 98.

The ejection timing correction time calculation unit 98 is a calculation unit which calculates a correctional amount (correction time) for the ejection timings, by taking account of the amount of change in the deposition position and the conveyance speed V in the sub-scanning direction, and it supplies the calculation results (information on the correction times) to the print controller 80.

The print controller 80 determines an ejection timing for a corresponding nozzle by adding the correction time obtained from the ejection timing correction time calculation unit 98 and provides control signals to the timing signal generation circuit 83. In this way, ink ejection is performed by supplying drive signals from the head driver 84 to the actuators 58 (not shown in FIG. 9) of the print head 50, at prescribed timings, in accordance with the timing signals outputted by the timing signal generation circuit 83.

In FIG. 9, the deposition position change amount calculation unit 96 and the ejection timing correction time calculation unit 98 are shown respectively as separate blocks, but these calculation units may also be incorporated into the print controller 80. Furthermore, the calculation units (90, 96, 98) may be realized by means of dedicated signal processing circuits (hardware), or they may be realized by software, or alternatively, by a suitable combination of hardware and software.

Figure 10:
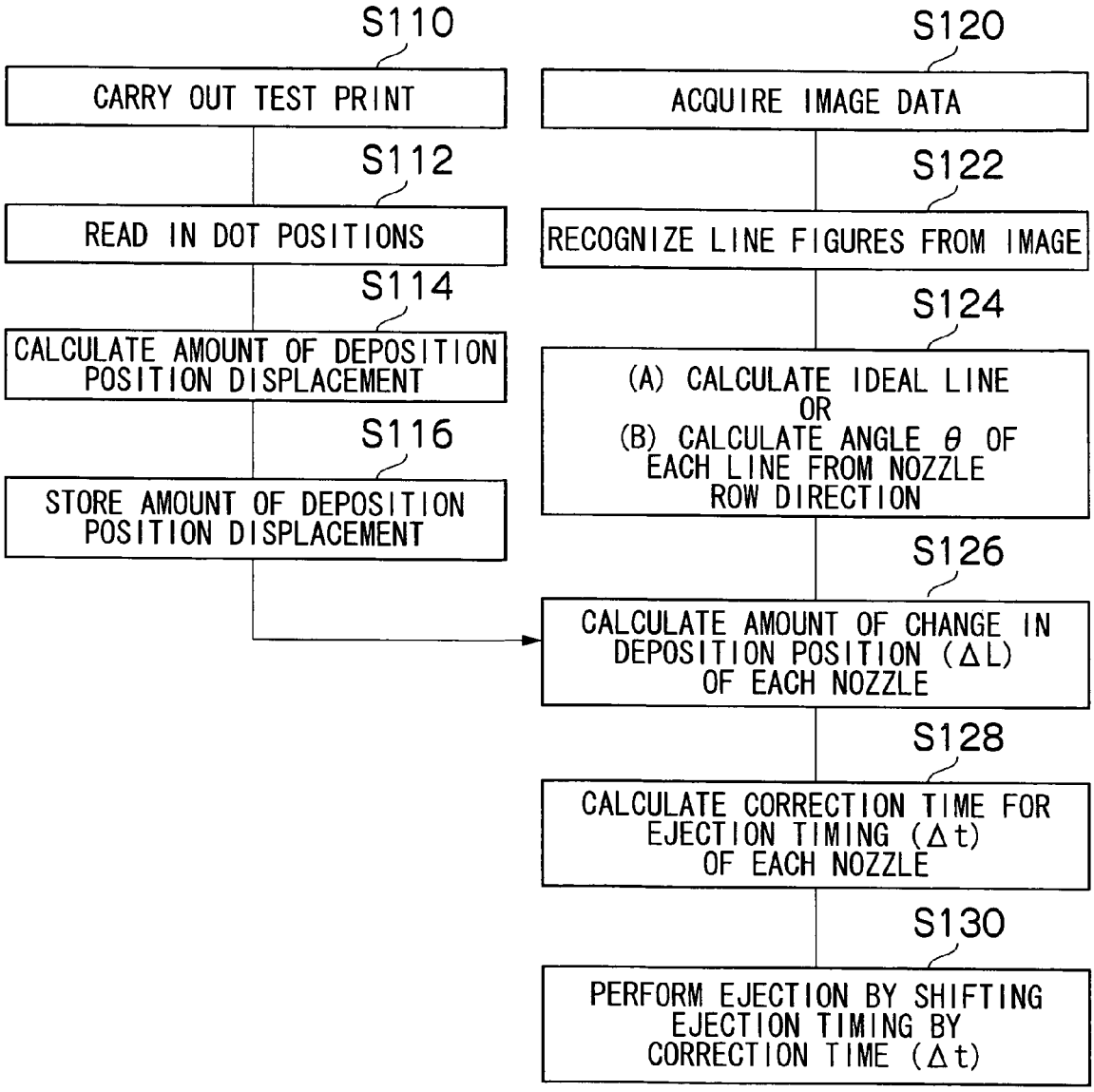
FIG. 10 is a flowchart showing one example of a control procedure in the inkjet recording apparatus according to the present embodiment.

FIG. 10 is a flowchart showing one example of a control procedure in the inkjet recording apparatus 10 according to the present embodiment.

Firstly, when the power supply is switched on, or on another occasion, a test print is implemented at a suitable timing (step S110), and the print results (the positions of the formed dots) are read in by the print determination unit 24 (step S112).

Thereupon, the amount of deposition position displacement which indicates the difference between the read in dot position and the ideal dot position (the ideal deposition position assuming that there is no ejection abnormality) is determined (step S114), and the amount of deposition position displacement data thus determined is stored in a storage unit (the amount of deposition position displacement storage unit 92 shown in FIG. 9) (step S116 in FIG. 10).

The test print executed at step S110 has print contents which allow the amount of deposition position displacement from the ideal deposition position to be measured (determined) for each nozzle, and in terms of the actual print pattern, and the like, a wide variety of different modes are possible. Desirably, a plurality of droplet ejection operations are performed by each nozzle, and the amount of displacement is determined by means of a statistical process (for example, averaging) from the plurality of measurement results. In this way, the characteristics relating to deposition position displacement are ascertained previously for each nozzle.

During printing, the image data is read in via the communication interface 70 (shown in FIG. 9) (step S120 in FIG. 10), and a line figure is recognized in the image (step S122). Processing is then carried out to determine the ideal line relating to the portion of the line figure thus recognized (step S124). In this case, as a method for identifying the ideal line, as shown in FIG. 7, there are: (A) a mode where the ideal line is defined in terms of a functional equation, or the like; and (B) a mode there the angle θ of each line with respect to the nozzle row direction is defined.

After identifying the ideal line at step S124 in FIG. 10, the procedure advances to step S126. At step S126, the amount of change in the deposition position (ΔL) for each nozzle is determined in accordance with the information on the amount of deposition position displacement stored at step S116 and the calculation method corresponding to the ideal line identification method (A) or (B) (these methods have already been described in relation to FIG. 7). Thereupon, an ejection timing correction time (Δt) for each nozzle is calculated from the amount of change in the deposition position (ΔL) thus calculated and the conveyance speed V in the sub-scanning direction (step S128 in FIG. 10), and ejection is performed by shifting the ejection timing of the corresponding nozzle by the correction time At for the ejection timing thus obtained (step S130). Accordingly, a droplet ejected from the defective nozzle is deposited on the ideal line.

Description of Further Example for Control

Hitherto, the example of control of the ejection timing in order to correct the deposition positions has been described principally with reference to the schematic drawing in FIG. 7; however, the scope of application of the present invention is not limited to this. Below, a further example for control is described.

Figure 11:
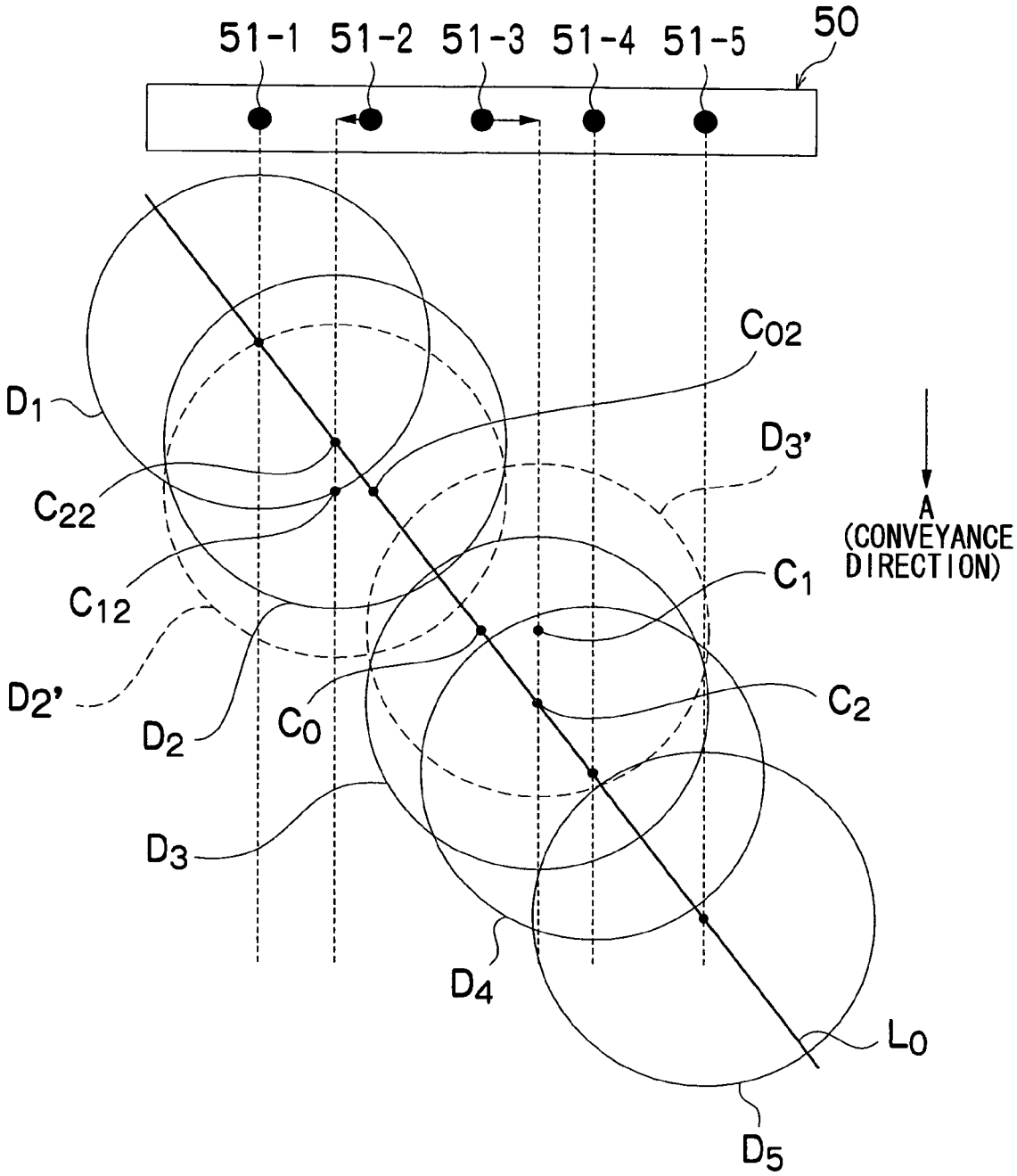
FIG. 11 is a schematic drawing for describing the phenomenon of line narrowing caused when correction is performed in a case where the deposition position displacements of two nozzles which form mutually adjacent dots act in mutually diverging directions.

FIG. 11 is a schematic drawing showing an example of a case where an ejection direction abnormality has occurred in two nozzles which eject droplets to form dots that are mutually adjacent in the main scanning direction. In this diagram, items which are the same as or similar to those in FIG. 7 are denoted with the same reference numerals and description thereof is omitted here. In the example shown in FIG. 11, the ejection from the central nozzle 51-3 (the third nozzle from the left) in the print head 50 is shifted toward the right, and the ejection from the second nozzle from the left, nozzle 51-2, is shifted toward the left. The phenomenon of deposition position displacement caused by the central nozzle 51-3 is similar to the example in FIG. 7. On the other hand, the deposition center position $C_{12}$ of the dot formed by a droplet ejected without correction from the nozzle 51-2 is shifted toward the left from the ideal deposition center position $C_{02}$.

FIG. 11 shows an example in which mutually adjacent dots are deposited by nozzles 51-2 and 51-3 which are adjacent in one nozzle row, but in the case of a nozzle group in a matrix arrangement such as that shown in FIG. 5, it is not necessary for two nozzles which eject droplets forming mutually adjacent dots to be disposed in adjacent positions on the nozzle surface.

In this way, when two nozzles which eject droplets forming mutually adjacent dots produce deposition position displacements in mutually opposite directions in the main scanning direction (the nozzle row direction in FIG. 11), and if the respective dots are deposited in mutually diverging directions, then if the ejection timing control described with reference to FIG. 7 to FIG. 10 is applied to the respective nozzles, (in other words, if timing correction is performed in order to correct the deposition positions in the sub-scanning direction in such a manner that the deposition center positions $C_{22}$ and $C_2$ of the dots $D_2$ and $D_3$ formed by droplets ejected from the nozzles 51-2 and 51-3 lie on the ideal line Lo), then dots are formed at the positions indicated by the solid circles $D_2$ and $D_3$ in FIG. 11.

As FIG. 11 reveals, by performing the above-described corrective control of the ejection timings, the distance between the centers of the dots $D_2$ and $D_3$ deposited by these two nozzles 51-2 and 51-3 (the distance between $C_{22}$ and $C_2$) becomes greater than the distance between the dot centers before correction (the distance between $C_{12}$ and $C_1$), and therefore, the dots $D_2$ and $D_3$ aligned on the ideal line $L_0$ become separated by a greater distance. Consequently, the width of the line segment depicted by this dot row becomes thinner between dots $D_2$ and $D_3$ (FIG. 11).

Figure 12:
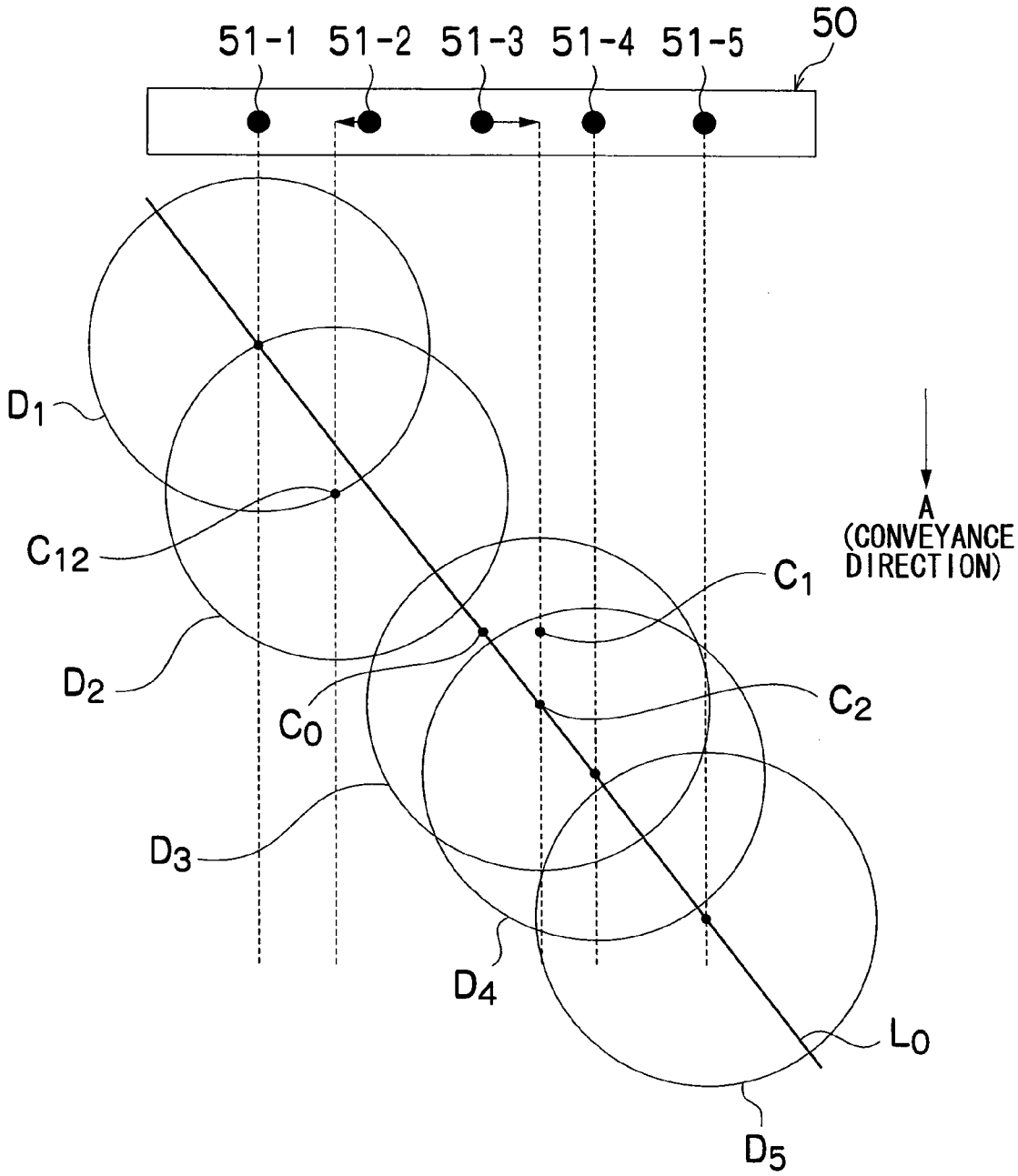
FIG. 12 is a schematic drawing for describing an example of control of the ejection timing according to the present embodiment in order to resolve the problem shown in FIG. 11.

In order to avoid situations of this kind, a mode is possible wherein, as shown in FIG. 12, the aforementioned correction (control for correcting the ejection timing in order that the deposition center position $C_0$ of a dot lies on the ideal line $L_0$) is only carried out in respect of one of the two nozzles 51-2 and 51-3 having the larger deposition position displacement (in FIG. 12, the nozzle 51-3), while the aforementioned correction of the ejection timing is not carried out in respect of the nozzle having the smaller deposition position displacement (in FIG. 12, nozzle 51-2).

Consequently, although the deposition center position $C_{12}$ of the dot $D_2$ from the uncorrected nozzle 51-2 does not lie on the ideal line Lo, the distance between the centers of the dots $D_2$ and $D_3$ in FIG. 12 is comparatively shorter than the distance between the centers of the $D_2$ and $D_3$ in FIG. 11, thus increasing the amount of overlap between the dots $D_2$ and $D_3$, and therefore, in FIG. 12, the change in the line thickness of the line segment depicted by the row of dots is reduced and line quality is improved compared to FIG. 11.

Figure 13:
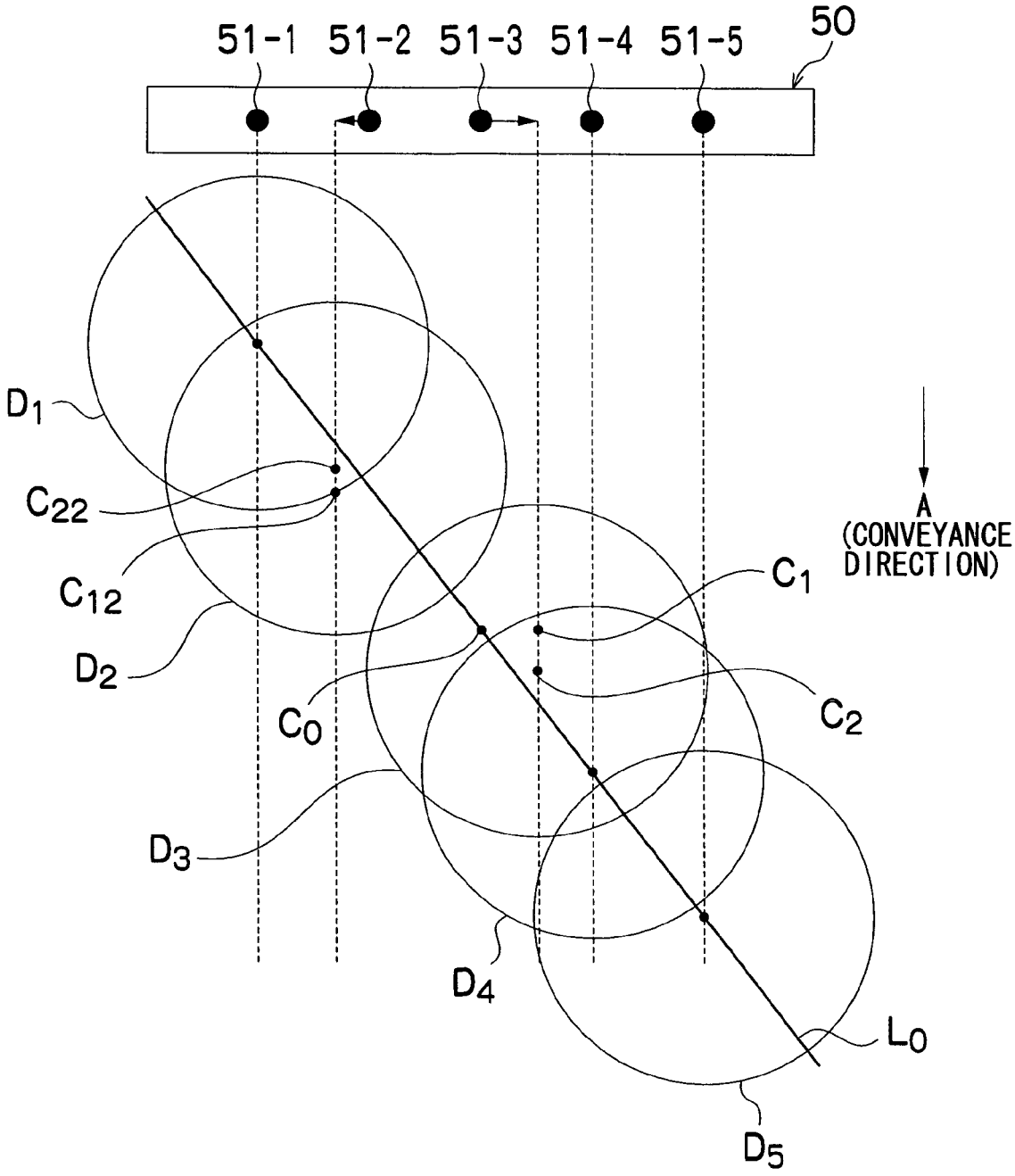
FIG. 13 is a schematic drawing for describing a further example of control of the ejection timing according to the present embodiment in order to resolve the problem shown in FIG. 11.

Instead of the example for control shown in FIG. 12, it is also possible to use the example for control shown in FIG. 13. In FIG. 13, items which are the same as or similar to those in FIG. 11 or FIG. 12 are denoted with the same reference numerals and description thereof is omitted here.

As shown in FIG. 13, the ejection timings are controlled in respect of the two nozzles 51-2 and 51-3 producing deposition position displacements, in such a manner that the deposition center positions of both are brought closer to the ideal line $L_0$, but the ejection timings are also controlled in such a manner that the respective deposition center positions $C_{22}$ and $C_2$ after correction are positioned between the deposition center positions $C_{12}$ and $C_1$ before correction (uncontrolled positions) and the ideal line $L_0$ (in other words, positions which do not coincide with the ideal line $L_0$).

By so doing, it is possible to avoid change in the line thickness (and in particular, narrowing of the line width), while improving the linearity of the row of dots, and therefore, line quality is improved in comparison with FIG. 11.

The foregoing description related to an example of a segment of a straight line depicted by one row of dots, but the scope of application of the present invention is not limited to this, and it may also be applied to line segments (thick lines) depicted by a group of dots from a plurality of rows and to curved lines.

In these cases, the concept of the "ideal line" is as defined below.

Figure 14A:
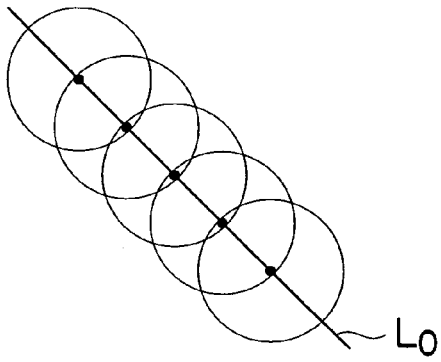
FIGS. 14A and 14B are illustrative diagrams for describing the definition of an ideal line in a case where a line is formed by one row of dots.
Figure 14B:
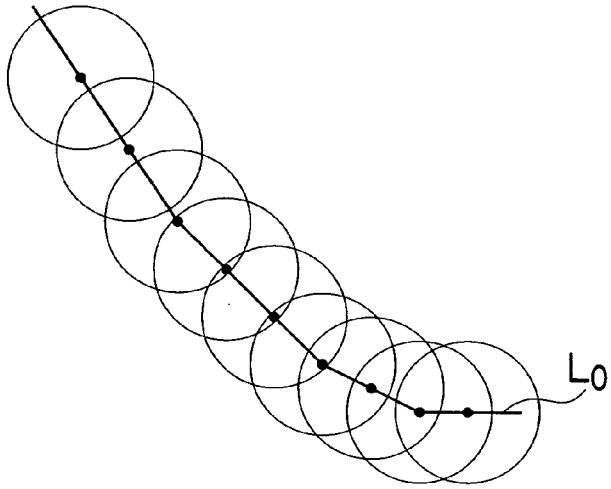

As described previously, the ideal line is a line which links the centers of the respective dots when it is supposed that there is absolutely no deposition position displacement, and as shown in FIGS. 14A and 14B, if a line is formed by a chain of single dots, then the ideal line is the line indicated by reference numeral $L_0$ in the diagrams. In the case of a curved line, each of the pixels is quantized, and therefore, as shown in FIG. 14B, the curve is represented by angled lines, which are effectively handled in the same way as straight lines.

Figure 15A:
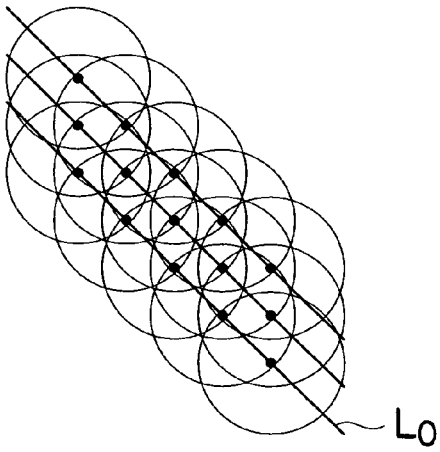
FIGS. 15A and 15B are illustrative diagrams for describing the definition of an ideal line in a case where a line is formed by a plurality of rows of dots.
Figure 15B:
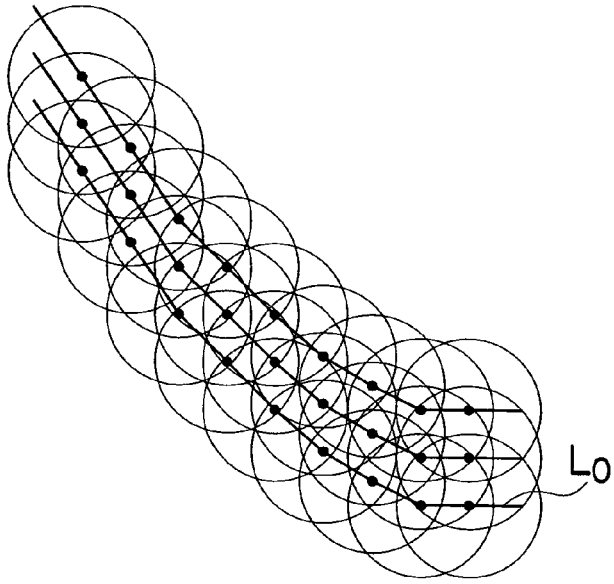

If a thick line composed of a plurality of dots is formed by moving the line shown in FIG. 14A or 14B in a parallel fashion, then the ideal line $L_0$ is defined in respect of the dots on the inner side of the line, as shown in FIG. 15A or 15B.

Figure 16A:
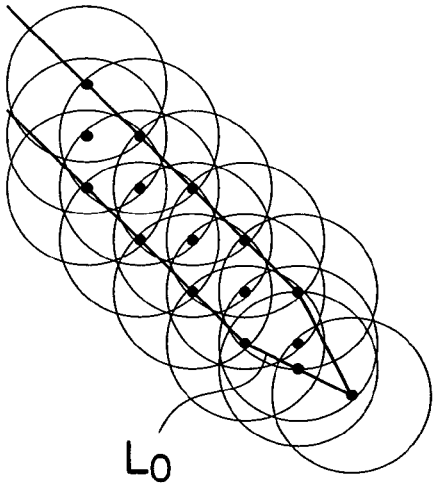
FIGS. 16A and 16B are illustrative diagrams for describing the definition of an ideal line in a case where the thickness of the line varies.
Figure 16B:
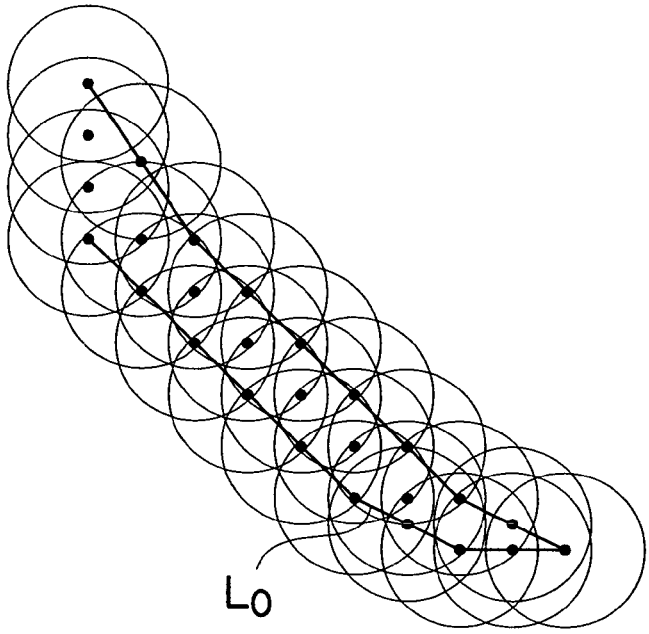

If the line thickness varies as shown in FIGS. 16A and 16B, then it becomes impossible to define the ideal line in respect of the dots on the inner side as shown in FIGS. 15A and 15B. Therefore, in this case, the ideal lines are defined only in respect of the dots in the outermost portions of the line, as shown in FIGS. 16A and 16B. Consequently, correction is only carried out in respect of these outermost portions.

To extend the theory shown in FIGS. 16A and 16B, it is possible to define the ideal line in respect of the boundary sections (outermost sections) of color-divided regions, for example, and therefore, deterioration in the line quality of boundary lines caused by deposition position displacement can be reduced.

In the above-described embodiments, an inkjet recording apparatus using a page-wide full line type head having a nozzle row of a length corresponding to the entire width of the recording medium has been described, but the scope of application of the present invention is not limited to this, and the present invention may also be applied to an inkjet recording apparatus using a shuttle head which performs image recording while moving a short recording head reciprocally. In the case of a shuttle head, the direction of reciprocal movement of the recording head is the main scanning direction, and the conveyance direction of the recording medium is the sub-scanning direction.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An image forming apparatus, comprising:

a recording head which includes a plurality of nozzles through which droplets of liquid are ejected to and deposited on a recording medium to form dots on the recording medium, the nozzles being arranged in a nozzle row;

a conveyance device which causes the recording head and the recording medium to move relatively to each other by conveying at least one of the recording head and the recording medium in a relative movement direction;

a storage device which, of information indicating an amount of deposition position displacement from an ideal deposition position of the dots formed by the droplets ejected from the nozzles, stores information about the amount of deposition position displacement in at least a direction perpendicular to the relative movement direction of the conveyance device;

a line figure recognition processing device which carries out processing for recognizing line figures from image data for printing;

an ideal line identification device which determines an ideal line obtained by linking centers of the respective dots formed when printing a line figure, assuming that there is absolutely no deposition position displacement produced by any of the nozzles, in respect of the line figure recognized by the line figure recognition processing device; and an ejection timing control device which, when printing a line figure, controls ejection timing of a defective nozzle which produces deposition position displacement in a direction perpendicular to the relative movement direction, according to the information about the amount of deposition position displacement stored in the storage device and the ideal line determined by the ideal line identification device, in such a manner that a deposition center position of a dot formed by a droplet ejected from the defective nozzle moves closer to the ideal line, along the relative movement direction.

2. The image forming apparatus as defined in claim 1, wherein, when printing the line figure, taking the direction perpendicular to the relative movement direction to be an X axis, the relative movement direction to be a Y axis, an ideal deposition center position supposing that there is absolutely no deposition position displacement produced by the defective nozzle to be $(X_0, Y_0)$, the deposition center position in a case where no correction of the ejection timing is carried out with respect to the defective nozzle to be $(X_1, Y_1)$, the deposition center position after correction to be $(X_2, Y_2)$, a function representing the ideal line to be $Y=f(X)$, and a relative movement speed produced by the conveyance device to be V, then the ejection timing control device determines an amount of correction $\Delta t$ of the ejection timing by the following equation:

$$\Delta t=(Y_2-Y_1)/V=(f(X_1)-Y_1)/V.$$

3. The image forming apparatus as defined in claim 1, wherein, when printing the line figure, if the ideal line is a straight line, then, taking the amount of deposition position displacement in the direction perpendicular to the relative movement direction to be $\Delta d$, and the amount of deposition position displacement in the relative movement direction to be $\Delta d'$, of the amount of deposition position displacement between an ideal deposition center position supposing that there is absolutely no deposition position displacement produced by the defective nozzle and the deposition center position when no correction of the ejection timing is carried out in respect of the defective nozzle, taking an angle formed between the ideal line and a straight line aligned in the direction perpendicular to the relative movement direction to be $\theta$, and a relative conveyance speed produced by the conveyance device to be V, then the ejection timing control device determines an amount of correction Δt of the ejection timing by the following equation:

$$\Delta t=(\Delta d\times\tan\theta-\Delta d').$$

4. The image forming apparatus as defined in claim 1, wherein the ejection timing control device implements control of the ejection timing only in respect of a nozzle at which the amount of deposition position displacement in the direction perpendicular to the relative movement direction exceeds a prescribed reference value.

5. The image forming apparatus as defined in claim 1, wherein, in a case where deposition position displacements are produced respectively in the dots formed by droplets ejected from two of the nozzles capable of forming two dots that are mutually adjacent in the direction perpendicular to the relative movement direction, if these deposition position displacements are produced in mutually divergent directions with respect to the direction perpendicular to the relative movement direction, then the ejection timing control device implements control of the ejection timing only in respect of one of the two nozzles that produces a larger amount of deposition position displacement in the direction perpendicular to the relative movement direction than the other of the two nozzles.

6. The image forming apparatus as defined in claim 1, wherein, in a case where deposition position displacements are produced respectively in the dots formed by droplets ejected from two of the nozzles capable of forming two dots that are mutually adjacent in the direction perpendicular to the relative movement direction, if these deposition position displacements are produced in mutually divergent directions with respect to the direction perpendicular to the relative movement direction, then the ejection timing control device implements control of the ejection timing in respect of the two nozzles in such a manner that the deposition center positions of the respective dots formed by the droplets ejected from the two nozzles lie between the ideal line and the deposition center positions produced when no ejection timing control is performed.

7. An image forming method of forming an image on a recording medium by ejecting droplets of liquid from a plurality of nozzles arranged in a nozzle row in a recording head, to the recording medium to form dots on the recording medium, while causing the recording head and the recording medium to move relatively to each other by conveying at least one of the recording head and the recording medium in a relative movement direction, comprising the steps of:

storing, of information indicating an amount of deposition position displacement from an ideal deposition position of the dots formed by the droplets ejected from the nozzles, information about the amount of deposition position displacement in at least a direction perpendicular to the relative movement direction;

carrying out processing for recognizing line figures from image data for printing;

determining an ideal line obtained by linking centers of the respective dots formed when printing a line figure, assuming that there is absolutely no deposition position displacement;

controlling, when printing a line figure, ejection timing of a defective nozzle which produces deposition position displacement in a direction perpendicular to the relative movement direction, according to the information about the amount of deposition position displacement stored in the storing step and the ideal line determined in the determining step, in such a manner that a deposition center position of a dot formed by a droplet ejected from the defective nozzle moves closer to the ideal line, along the relative movement direction.

8. An image forming apparatus, comprising:

a recording head which includes a plurality of nozzles through which droplets of liquid are ejected to and deposited on a recording medium to form dots on the recording medium, the nozzles being arranged in a nozzle row;

a conveyance device which causes the recording head and the recording medium to move relatively to each other by conveying at least one of the recording head and the recording medium in a relative movement direction;

a storage device which, of information indicating an amount of deposition position displacement from ideal deposition positions of the dots formed by the droplets ejected from the nozzles, stores information about the amount of deposition position displacement in at least a direction perpendicular to the relative movement direction of the conveyance device, the information indicating an amount of deposition position displacement from ideal deposition positions of the dots being obtained by measuring or inferring the amount of deposition position displacement from the ideal deposition positions of the dots to actual positions of the dots formed by the droplets ejected from the nozzles, the actual positions of the dots being obtained by reading the actual positions of the dots with an image sensor or by capturing images of the ejected droplets of the liquid in flight and calculating the actual positions of the dots from positions of the image-captured droplets of the liquid in flight;

a print controller which generates dot data from image data;

a line figure recognition processing device which carries out processing for recognizing a line figure including at least one of a line of a figure, a line of a graph, a character, and a boundary line between different color regions, from image data for printing by analyzing the image data for printing;

an ideal line identification device which determines an ideal line obtained by linking centers of the respective dots of a dot row based on the dot data formed when printing the line figure recognized by the line figure recognition processing device by means of the dot row, assuming that there is absolutely no deposition position displacement produced by any of the nozzles; and an ejection timing control device which, when printing the dot row corresponding to the line figure, controls ejection timing of a defective nozzle which produces deposition position displacement in a direction perpendicular to the relative movement direction, according to the information about the amount of deposition position displacement stored in the storage device and the ideal line determined by the ideal line identification device, in such a manner that a deposition center position of a dot formed by a droplet ejected from the defective nozzle moves closer to the ideal line, along the relative movement direction.

9. An image forming method of forming an image on a recording medium by ejecting droplets of liquid from a plurality of nozzles arranged in a nozzle row in a recording head, to the recording medium to form dots on the recording medium, while causing the recording head and the recording medium to move relatively to each other by conveying at least one of the recording head and the recording medium in a relative movement direction, comprising:

a storage step of storing in advance, of information indicating an amount of deposition position displacement from ideal deposition positions of the dots formed by the droplets ejected from the nozzles, information about the amount of deposition position displacement in at least a direction perpendicular to the relative movement direction, the information indicating an amount of deposition position displacement from ideal deposition positions of the dots being obtained by measuring or inferring the amount of deposition position displacement from the ideal deposition positions of the dots to actual positions of the dots formed by the droplets ejected from the nozzles, the actual positions of the dots being obtained by reading the actual positions of the dots with an image sensor or by capturing images of the ejected droplets of the liquid in flight and calculating the actual positions of the dots from positions of the image-captured droplets of the liquid in flight;

a signal processing step of generating dot data from image data;

a line figure recognition processing step of carrying out processing for recognizing a line figure including at least one of a line of a figure, a line of a graph, a character, and a boundary line between different color regions, from image data for printing by analyzing the image data for printing; and an ideal line identification step of determining an ideal line obtained by linking centers of the respective dots of a row based on the dot data formed when printing the line figure recognized in the line figure recognition processing step by means of the dot row, assuming that there is absolutely no deposition position displacement produced by any of the nozzles; and an ejection timing control step of, when printing the dot row corresponding to the line figure, controlling ejection timing of a defective nozzle which produces deposition position displacement in a direction perpendicular to the relative movement direction, according to the information stored in the storage step and the ideal line determined in the ideal line identification step, in such a manner that a deposition center position of a dot formed by a droplet ejected from the defective nozzle moves closer to the ideal line, along the relative movement direction.

* * * * *